US009193547B2

(12) United States Patent
Suzuki

(10) Patent No.: US 9,193,547 B2
(45) Date of Patent: Nov. 24, 2015

(54) SHEET CONVEYER DEVICE AND IMAGE FORMING APPARATUS

(71) Applicant: Takashi Suzuki, Aichi (JP)

(72) Inventor: Takashi Suzuki, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 69 days.

(21) Appl. No.: 13/953,829

(22) Filed: Jul. 30, 2013

(65) Prior Publication Data

US 2014/0037350 A1 Feb. 6, 2014

(30) Foreign Application Priority Data

Aug. 3, 2012 (JP) ..... 2012-172596

(51) Int. Cl.
*G03G 15/00* (2006.01)
*B65H 7/02* (2006.01)

(52) U.S. Cl.
CPC ..... *B65H 7/02* (2013.01); *G03G 15/6514* (2013.01); *G03G 15/70* (2013.01); *B65H 2407/21* (2013.01); *B65H 2511/11* (2013.01);
(Continued)

(58) Field of Classification Search
CPC ... G03G 15/00; G03G 15/6514; G03G 15/70; G03G 2215/0141; B65H 7/00; B65H 7/06; B65H 7/02; B65H 2407/21; B65H 2511/11; B65H 2511/51; B65H 2513/512; B65H 2513/514; B65H 2513/53; B65H 2701/1311; B65H 2701/1313; B65H 2801/06
USPC ..... 399/21, 23, 392, 16
See application file for complete search history.

(56) References Cited

U.S. PATENT DOCUMENTS 4,392,740 A * 7/1983 Ito et al. ..... 399/21
4,743,941 A * 5/1988 Takano ..... 399/21
(Continued)

FOREIGN PATENT DOCUMENTS

CN 101729717 A 6/2010
JP 04144854 A * 5/1992 ..... G03G 15/00
(Continued)

OTHER PUBLICATIONS

Notification of First Office Action dated Jun. 2, 2015 received from the Chinese Patent Office in related application CN 201310334353.0 together with an English language translation.

*Primary Examiner* — Nguyen Ha
(74) *Attorney, Agent, or Firm* — Scully, Scott, Murphy & Presser, P.C.

(57) ABSTRACT

A sheet conveyer, including a manual-feed conveyer path; a first sensor to detect presence of the sheet inserted in the manual-feed conveyer path; an upstream-side conveyer and a downstream-side conveyer to convey the sheet toward a downstream side; a second sensor to detect presence of the sheet in a downstream position with respect to the upstream-side conveyer, the second sensor being switchable between a presence-detectable state and an absence-detectable state; and a controller is provided. The controller measures presence-detecting duration of the sheet by the second sensor and controls the downstream-side conveyer to continue conveying the sheet if the first sensor is detecting presence of the sheet when the second sensor is switched to the absence-detectable state, and if a difference between a value calculated based on the measured presence-detecting duration and a reference value obtained based on a reference sheet length is smaller than a predetermined threshold.

26 Claims, 12 Drawing Sheets

(52) U.S. Cl.
CPC ..... *B65H2511/51* (2013.01); *B65H 2513/512* (2013.01); *B65H 2513/514* (2013.01); *B65H 2513/53* (2013.01); *B65H 2701/1311* (2013.01); *B65H 2701/1313* (2013.01); *B65H 2801/06* (2013.01); *G03G 2215/0141* (2013.01)

(56) References Cited

U.S. PATENT DOCUMENTS

| | | | | |
|---|---|---|---|---|
| 7,379,678 | B2 * | 5/2008 | Motoyama et al. | 399/16 |
| 2005/0078973 | A1 * | 4/2005 | Suzuki | 399/45 |
| 2010/0021185 | A1 * | 1/2010 | Okano | 399/16 |

FOREIGN PATENT DOCUMENTS

| | | | |
|---|---|---|---|
| JP | 4267169 | A | 9/1992 |
| JP | 7092859 | A | 4/1995 |
| JP | 2006-298561 | A | 11/2006 |
| JP | 2009-256069 | A | 11/2009 |
| JP | 2011-123415 | A | 6/2011 |

* cited by examiner

SHEET CONVEYER DEVICE AND IMAGE FORMING APPARATUS

CROSS REFERENCE TO RELATED APPLICATION

This application claims priority from Japanese Patent Application No. 2012-172596, filed on Aug. 3, 2012, the entire subject matter of which is incorporated herein by reference.

BACKGROUND

1. Technical Field

An aspect of the present invention relates to a technique to convey sheets via a sheet conveying path provided for manually inserted sheets.

2. Related Art

A printing apparatus with sensors to detect a manually-inserted sheet in a sheet conveying path is known. In the printing apparatus, when a manual-insert sensor is switched on to indicate presence of a manually-inserted sheet, but an ejection sensor is not switched on to indicate presence of the sheet within a predetermined time period, it may be determined that the manually-inserted sheet is jammed in the sheet conveying path. While the manually-inserted sheet is jammed and not conveyed along the sheet conveying path, a printing operation with the manually-inserted sheet may be stopped.

Meanwhile, if the manual-insert sensor is switched on by a manually-inserted sheet, and if the manual-insert sensor is not switched off by the same manually-inserted sheet within a predetermined time period corresponding to a length of the sheet, it may be recognized that the manually-inserted sheet is inserted to reach a detective range of the manual-insert sensor while a preceding sheet is still in the detective range of the manual-insert sensor. In this regard, a tail end of the preceding sheet and a leading end of the following sheet may be undesirably in proximity to each other along the sheet conveying path. Therefore, although it may be recognized as a user's sheet-inserting error, no sheet jam is in fact occurring. Based on the recognition that the manually inserted sheets are serially conveyed without being jammed along the sheet conveying path, the printing operation with the successively inserted sheets may be continued. In other words, the printing operation may not necessary be stopped or aborted.

On the other hand, a user once inserting a sheet through a manual sheet inlet may take out the sheet from the sheet conveying path in a short time period. In such a case, while the once-inserted sheet is no longer conveyed in the sheet conveying path, it may be preferable that the printing operation is stopped. In other words, the printing operation may be stopped when an assumption that the once-inserted sheet is withdrawn is made.

SUMMARY

However, while the behavior of the manual-insert sensor may not clearly indicate if it is the manually-inserted sheet reaching the detective range of the manual-insert sensor while the preceding sheet still remains in the detective range, or if it is the once-inserted sheet being immediately withdrawn, it is possible that the printing operation may be unnecessarily stopped based on the assumption that the once-inserted sheet is withdrawn, even though it is in fact the manually-inserted sheet successively reaching the detective range of the manual-insert sensor while the preceding sheet still remains in the detective range. Therefore, simply stopping the printing operation may cause inconvenience on the user.

In view of such consideration, the present invention is advantageous in providing a technique to improve usability of the manual sheet-supplying function.

According to an aspect of the present invention, a sheet conveyer is provided. The sheet conveyer includes a manual-feed conveyer path, in which a sheet is inserted manually and conveyed along a sheet conveying direction; a first sensor arranged along the manual-feed conveyer path and configured to detect presence of the sheet inserted in the manual-feed conveyer path; an upstream-side conveyer configured to convey the sheet having passed by the first sensor toward a downstream side along the sheet conveying direction; a downstream-side conveyer configured to convey the sheet conveyed by the upstream-side conveyer further toward the downstream side along the sheet conveying direction; a second sensor arranged along the manual-feed conveyer path in a downstream position with respect to the upstream-side conveyer along the sheet conveying direction and configured to detect presence of the sheet in the downstream position with respect to the upstream-side conveyer, the second sensor being switchable between a presence-detectable state, in which the second sensor detects presence of the sheet, and an absence-detectable state, in which the second sensor detects absence of the sheet; and a controller. The controller is configured to measure presence-detecting duration, which starts when the second sensor is switched from the absence-detectable state to the presence-detectable state and ends when the second sensor is switched from the presence-detectable state to the absence-detectable state; and control the downstream-side conveyer to stop conveying the sheet if the first sensor is detecting presence of the sheet when the second sensor is switched from the presence-detectable state to the absence-detectable state, and if a difference between a value calculated based on the measured presence-detecting duration and a reference value obtained based on a reference sheet length of an assumed sheet along the sheet conveying direction is equal to or larger than a predetermined threshold, and to continue conveying the sheet if the first sensor is detecting presence of the sheet when the second sensor is switched from the presence-detectable state to the absence-detectable state, and if the difference between the value calculated based on the measured presence-detecting duration and the reference value obtained based on the reference sheet length of an assumed sheet along the sheet conveying direction is smaller than the predetermined threshold.

According to another aspect of the present invention, an image forming apparatus is provided. The image forming apparatus includes a manual-feed conveyer path, in which a sheet is inserted manually and conveyed along a sheet conveying direction; a first sensor arranged along the manual-feed conveyer path and configured to detect presence of the sheet inserted in the manual-feed conveyer path; an upstream-side conveyer configured to convey the sheet having passed by the first sensor toward a downstream side along the sheet conveying direction; a downstream-side conveyer configured to convey the sheet conveyed by the upstream-side conveyer further toward the downstream side along the sheet conveying direction; an image forming unit configured to form an image on the manually inserted sheet conveyed through the manual-feed conveyer path; a second sensor arranged along the manual-feed conveyer path in a downstream position with respect to the upstream-side conveyer and on an upstream position with respect to the image forming unit along the sheet conveying direction and configured to detect presence of the sheet in the downstream position with respect to the upstream-side conveyer, the second sensor being switchable between a presence-detectable state, in which the second sensor detects presence of the sheet, and an absence-detectable state, in which the second sensor detects absence of the sheet; and a controller. The controller is configured to measure presence-detecting duration, which starts when the second sensor is switched from the absence-detectable state to the presence-detectable state and ends when the second sensor is switched from the presence-detectable state to the absence-detectable state; and control the downstream-side conveyer to stop conveying the sheet if the first sensor is detecting presence of the sheet when the second sensor is switched from the presence-detectable state to the absence-detectable state, and if a difference between a value calculated based on the measured presence-detecting duration and a reference value obtained based on a reference sheet length of an assumed sheet along the sheet conveying direction is equal to or larger than a predetermined threshold, and to continue conveying the sheet if the first sensor is detecting presence of the sheet when the second sensor is switched from the presence-detectable state to the absence-detectable state, and if the difference between the value calculated based on the measured presence-detecting duration and the reference value obtained based on the reference sheet length of the assumed sheet along the sheet conveying direction is smaller than the predetermined threshold.

According to another aspect of the present invention, a sheet conveyer configured to convey a sheet in a predetermined conveyer path along a predetermined sheet conveying direction from an upstream side toward a downstream side, the sheet having a predetermined sheet length along the sheet conveying direction, is provided. The sheet conveyer includes a first sensor arranged along the conveyer path and configured to detect presence and absence of the sheet when the sheet passes by the first sensor, the first sensor being configured to output presence-detectable signals indicating presence of the sheet when presence of the sheet is detected and absence-detectable signals indicating absence of the sheet when absence of the sheet is detected; an upstream-side conveyer arranged along the conveyer path in a downstream position with respect to the first sensor along the sheet conveying direction and configured to convey the sheet having passed by the first sensor toward the downstream side; a downstream-side conveyer arranged along the conveyer path in a downstream position with respect to the upstream-side conveyer along the sheet conveying direction and configured to convey the sheet conveyed by the upstream-side conveyer further toward the downstream side; a second sensor arranged along the conveyer path in a downstream position with respect to the upstream-side conveyer along the sheet conveying direction and configured to detect presence and absence of the sheet when the sheet passes by the second sensor, the second sensor being switchable between a presence-detectable state, in which the second sensor detects presence of the sheet, and an absence-detectable state, in which the second sensor detects absence of the sheet; and a controller. The controller is configured to obtain assumed duration, which is assumed to be required for an assumed sheet having the reference sheet length to be conveyed for a predetermined distance; measure presence-detecting duration, which starts when the second sensor is switched from the absence-detectable state to the presence-detectable state and ends when the second sensor is switched from the presence-detectable state to the absence-detectable state; control the downstream-side conveyer to continue conveying the sheet, if the first sensor is outputting the presence-detectable signals when the second sensor is switched from the presence-detectable state to the absence-detectable state, and if a difference between the measured presence-detecting duration and the obtained assumed duration is smaller than a predetermined threshold; and control the downstream-side conveyer to stop conveying the sheet if the first sensor is outputting the presence-detectable signals when the second sensor is switched from the presence-detectable state to the absence-detectable state, and if the difference between the measured presence-detecting duration and the obtained assumed duration is one of greater than and equal to the predetermined threshold.

BRIEF DESCRIPTION OF THE ACCOMPANYING DRAWINGS

DETAILED DESCRIPTION

Figure 1:
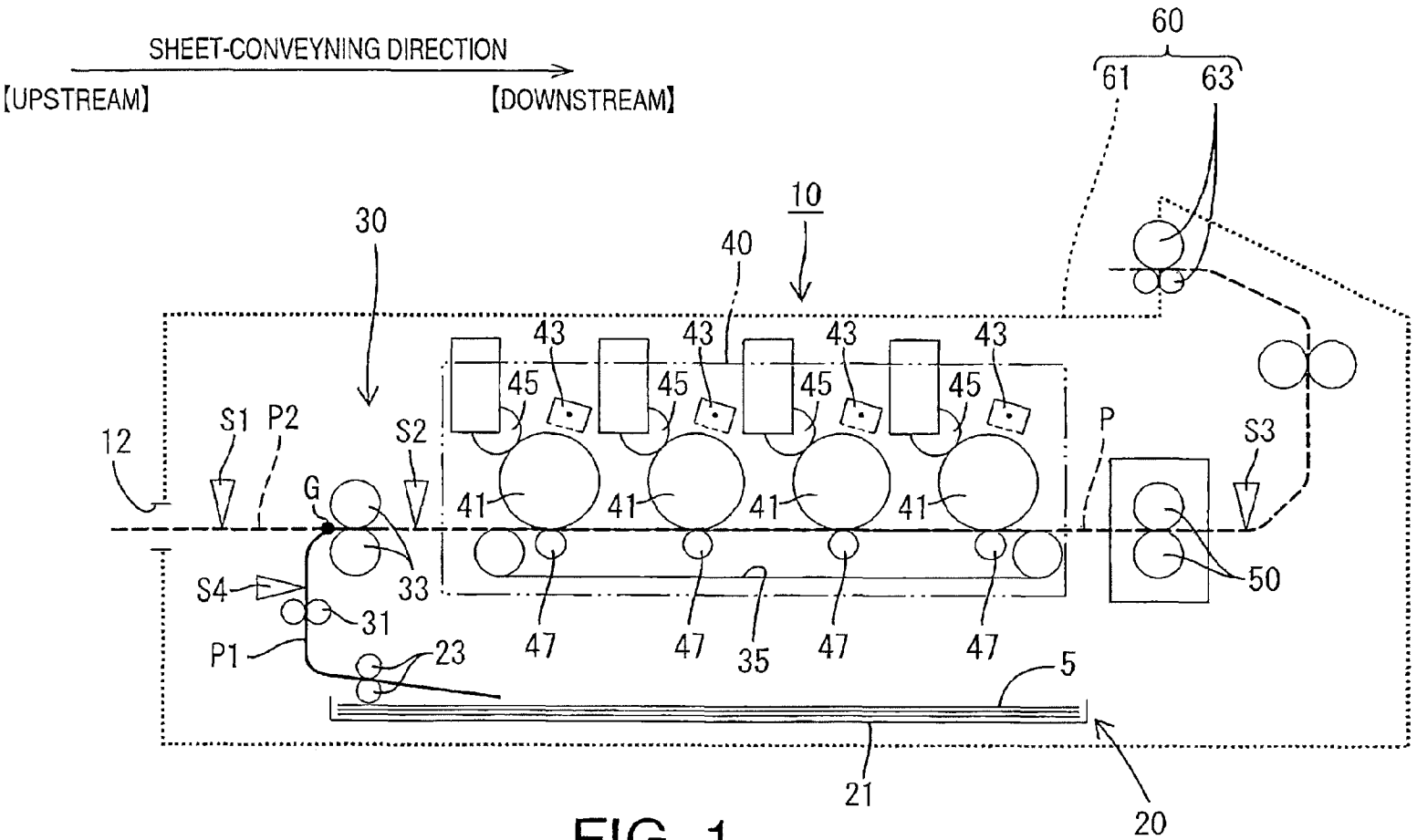
FIG. 1 is an illustrative cross-sectional view of a printer according to an embodiment of the present invention.

Hereinafter, embodiments of the present invention will be described with reference to the accompanying drawings.

1. Internal Configuration of Printer

Firstly, an internal configuration of a printer 10 according to a first embodiment will be described with reference to FIG. 1. The printer 10 according to the embodiment of the present invention is a direct tandem-typed color LED printer, which forms colored images by layering images in multiple colors (e.g., black, yellow, magenta, and cyan) on a sheet 5 being conveyed. In the printer 10, in a section between a merging point G and a fixing unit 50, the sheet 5 is conveyed to flow from a left-hand side toward a right-hand side in FIG. 1. Therefore, the left-hand side in FIG. 1 may be referred to as an upstream side for the sheet 5 being conveyed, and the right-hand side in FIG. 1 may be referred to as a downstream side for the sheet 5 being conveyed. The sheet 5 has a sheet length L, which is a dimension of the sheet 5 being conveyed along the sheet conveying direction.

The printer 10 includes a sheet feeder 20, a sheet conveyer 30, an image forming unit 40, the fixing unit 50, and an ejection unit 60. Inside the printer 10, an auto-feed conveyer path P1, in which sheets picked up from a tray 21 are guided to be conveyed, and a manual-feed conveyer path P2, in which manually inserted sheets are guided to be conveyed, are formed.

In the printer 10 of the present embodiment, the auto-feed conveyer path P1 and the manual-feed conveyer path P2 merge into a conveyer path P at the merging point which is in an upstream position with respect to registration rollers 33 along the sheet conveying direction. Outlines of the auto-feed conveyer path P1, the manual-feed conveyer path P2, and the conveyer path P may be formed by, for example, rollers, which will be described below in detail, guiding members (not shown).

The sheet feeder 20 is disposed in a lower position in the printer 10 to feed the sheets 6 from the tray 21. The sheet feeder 20 includes the tray 21 to accommodate the sheets 5 and pickup rollers 23 to pick up the sheets 5 from the tray 21.

The sheet conveyer 30 conveys the sheets 5 fed by the sheet feeder 20 and manually inserted sheets toward the downstream side, on which the image forming unit 40 is disposed. The sheet conveyer 30 includes the auto-feed conveyer path P1, the manual-feed conveyer path P2, an auxiliary feed roller 31, the registration rollers 33, and a conveyer belt 35.

The registration rollers 33 align the sheets 5 conveyed through the auto-feed conveyer path P1 and the manual-feed conveyer path P2 in a correct orientation and forward the sheets 5 to the image forming unit 40. The conveyer belt 35 conveys the sheets 5 forwarded by the registration rollers 33 through the image forming unit 40 and forwards further toward the fixing unit 25 on the downstream side. Thus, the registration rollers 33 are arranged on the upstream side with respect to the conveyer belt 35, and the conveyer belt 35 is arranged on the downstream side with respect to the registration rollers 33.

The image forming unit 40 is a direct tandem image forming unit, which forms a multi-colored image in an electrophotographic method by transferring images in multiple colors of toners in layers directly on the sheet 5 being conveyed. The image forming unit 40 has a photosensitive drum 41, a charger 43, a developer roller 45, and a transfer roller 47 for each colored toner to compose the multi-colored image.

The fixing unit 50 is arranged in a downstream position with respect to the image forming unit 40 along the conveyer path P. The fixing unit 50 fixes the multi-colored image transferred on the sheet P thermally there-onto. The ejection unit 60 includes an ejection tray 61 and ejection rollers 63. The ejection unit 60 conveys the sheet 5 with the fixed image toward the ejection tray 61 to eject.

The manual-feed conveyer path P2 is a route, through which a manually-inserted sheet is conveyed to have the image formed thereon. The manual-feed conveyer path 2 is formed on a front side of the printer 10. The sheet 5 may be fed in the manual-feed conveyer path P2 through an opening 12, which is formed on a front face of the printer 10.

The sheet conveyer 30 further includes a first sensor S1, a second sensor S2, a third sensor S3, and a fourth sensor S4. The first sensor S1 is arranged along the manual-feed conveyer path P2 in an upstream position with respect to the registration rollers 33. When the sheet 5 is in the manual-feed conveyer path P2, the first sensor S1 detects presence of the sheet 5 and outputs "on" signals to indicate the presence, and when no sheet 5 is detected in the manual-feed conveyer path P2, i.e., when absence of the sheet 5 from the manual-feed conveyer path P2 is detected, the first sensor S1 outputs "off" signals.

The second sensor S2 is arranged along the conveyer path P in a downstream position with respect to the registration rollers 33 and in an upstream position with respect to the image forming unit 40. The second sensor S2 detects the sheet 5 in the downstream area with respect to the registration rollers 33 in the conveyer path P and indicates presence of the sheet 5. When presence of the sheet 5 in the conveyer path P in the downstream area is detected, the second sensor S2 outputs "on" signals, and when no sheet 5 is detected in the downstream area in the conveyer path P, i.e., when absence of the sheet 5 from the conveyer path P is detected, the second sensor S2 outputs "off" signals.

The third sensor S3 is arranged along the conveyer path P in a downstream position with respect to the fixing unit 50. The third sensor S3 detects the sheet 5 in the downstream area with respect to the fixing unit 50 in the conveyer path P and indicates presence of the sheet 5. The fourth sensor S4 is arranged along the auto-feed conveyer path P1 and in a position between the auxiliary feed roller 31 and the registration rollers 33. The fourth sensor S4 detects the sheet 5 fed from the tray 21. When presence of the sheet 5 is detected by the third sensor S3 or the fourth sensor S4, the third sensor S3 or the fourth sensor S4 outputs "on" signals respectively, and when absence of the sheet 5 is detected, the third sensor S3 or the fourth sensor S4 outputs "off" signals respectively.

According to the present embodiment, a distance L23 (see FIG. 3) between the second sensor S2 and the third sensor S3 along the conveyer path P is reserved to be greater than a sheet length Lo of the sheet 5. In the present embodiment, the sheet 5 is assumed to have a standard size "A4", of which length along the sheet conveying direction is 297 mm. In other words, the reference sheet length Lo of the assumed sheet 5 is 297 mm, and the distance L23 between the second sensor S2 and the third sensor S3 is reserved to be at least 297 mm.

2. Electrical Configuration of the Printer

Figure 2:
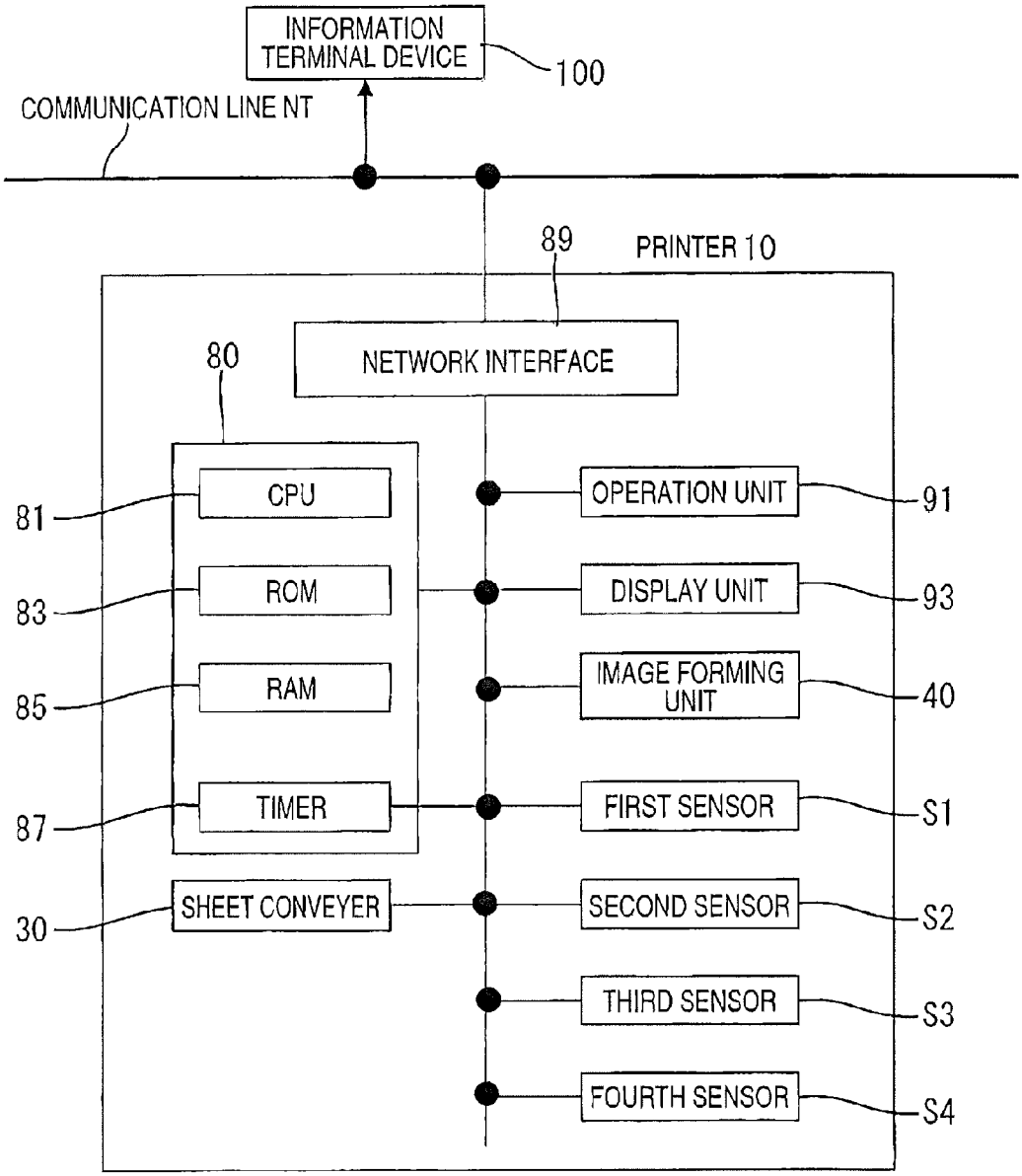
FIG. 2 is a block diagram to illustrate an electrical configuration of the printer according to the embodiment of the present invention.

Next, an electrical configuration of the printer 10 will be described with reference to FIG. 2. The printer 10 includes a controller 80, an operation unit 91, a display unit 93, the image forming unit 40, a network interface 89, the first-fourth sensors S1-S4, a timer 87, and the sheet conveyer 30.

The controller 80 includes a central processing unit (CPU) 81, a read-only memory (ROM) 83, a random access memory (RAM) 85, and the timer 87. The ROM 83 stores various programs to control the printer 10. The CPU 81 executes calculations according to the programs read from the ROM 83, stores the results obtained from the calculations in the RAM 85, and controls behaviors of the components in the printer 10, including the image forming unit 40 and the sheet conveyer 30, based on the calculations. The timer 87 is used when the CPU 81 measures timings.

The operation unit 91 includes a plurality of buttons (not shown), and a user's instructions concerning the printing operation may be entered through the buttons. The display unit 93 includes a liquid crystal display and lamps, which can display a configuration screen and indicate condition of the printer 10. The network interface 89 provides connection to the printer 10 with an information terminal device, such as a personal computer (PC) and a facsimile machine, via a network line NT. Through the network interface 89, the printer 10 can exchange data with the information terminal device 100.

3. Manual Sheet Feed

Figure 3:
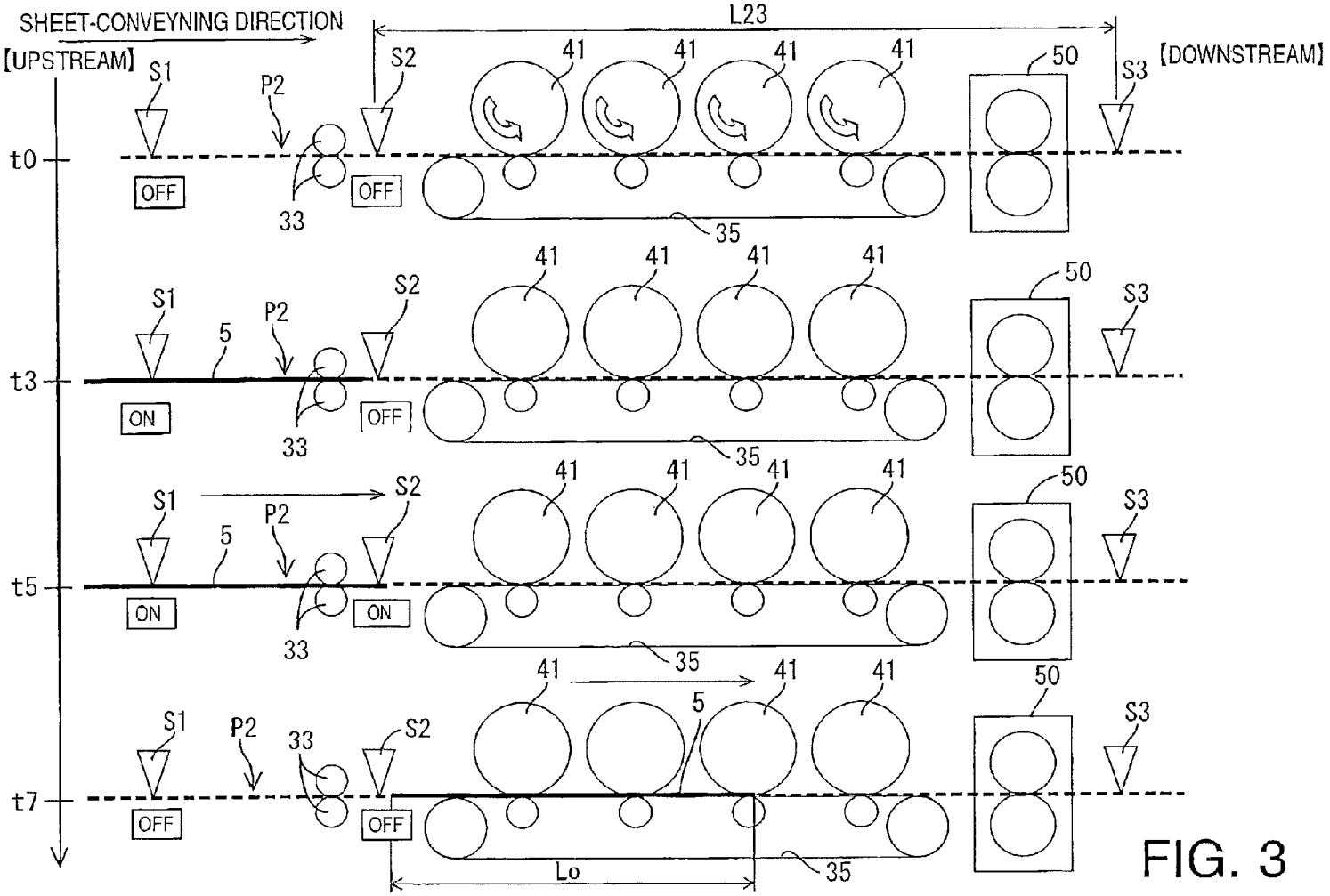
FIG. 3 is a diagram to illustrate behaviors of a first sensor and a second sensor while a sheet is inserted and conveyed in the printer according to the embodiment of the present invention.
Figure 4:
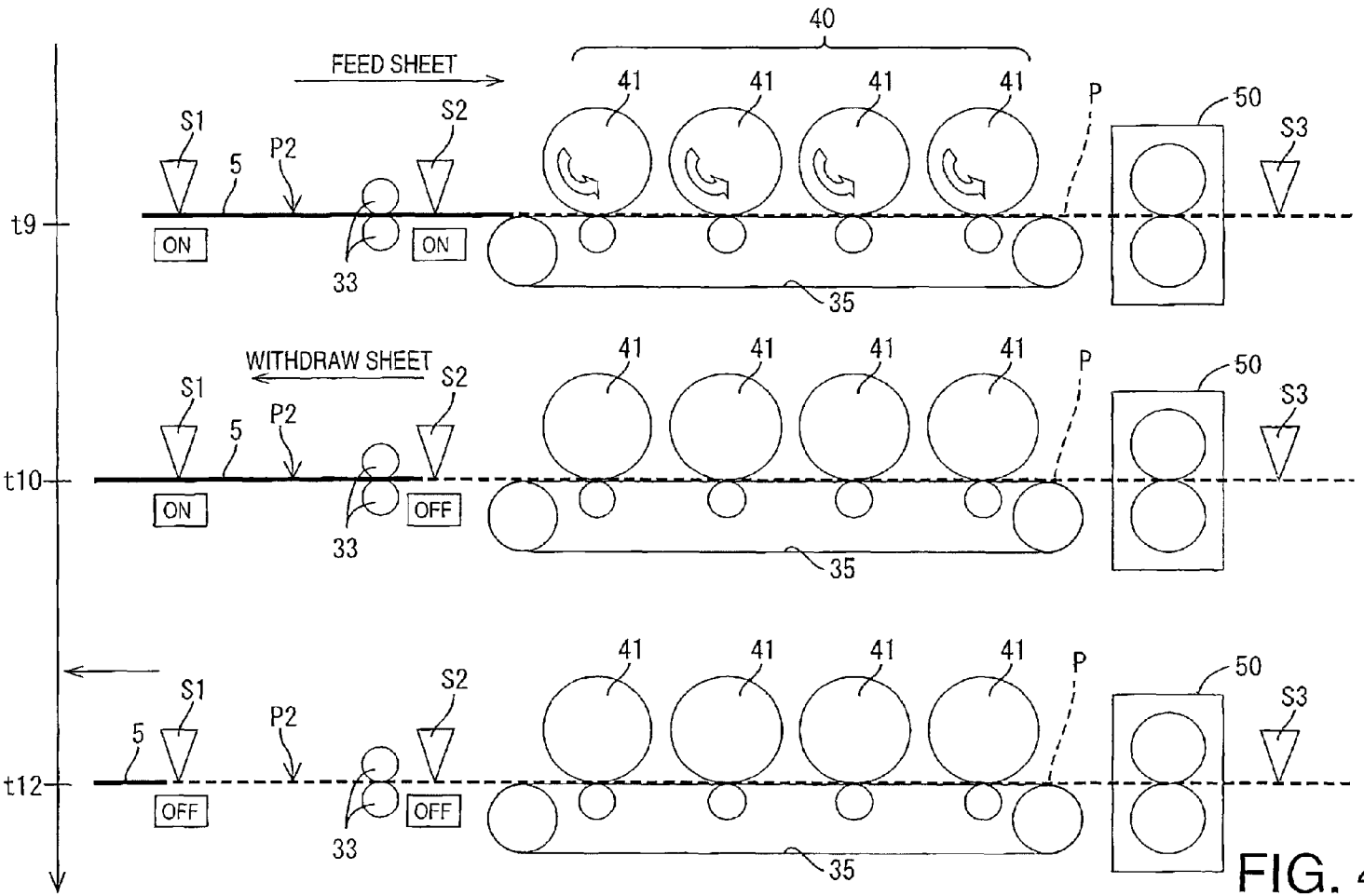
FIG. 4 is a diagram to illustrate behaviors of the first sensor and the second sensor while a sheet is inserted in and withdrawn from the printer according to the embodiment of the present invention.
Figure 5:
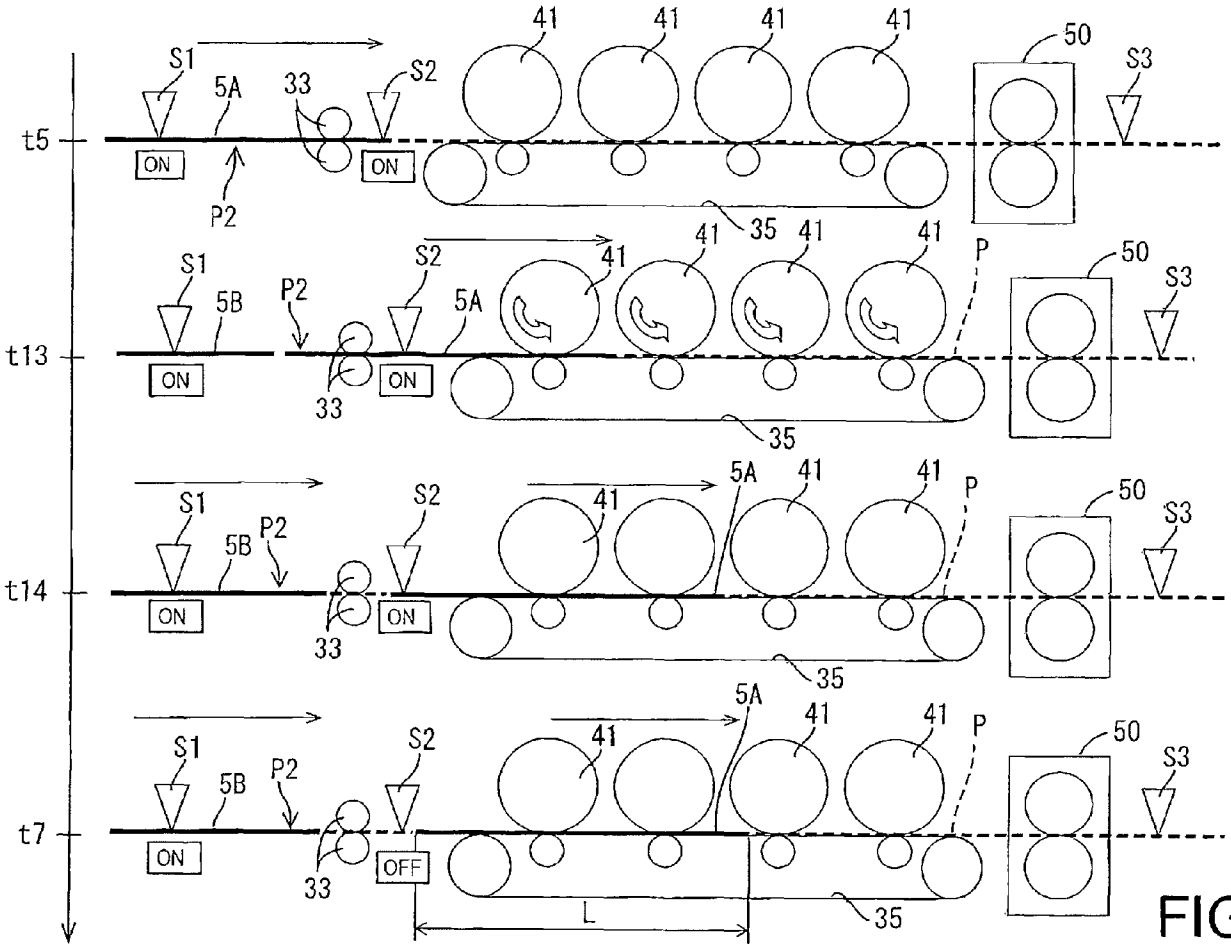
FIG. 5 is a diagram to illustrate behaviors of the first sensor and the second sensor while sheets are successively inserted and conveyed in the printer according to the embodiment of the present invention.
Figure 6:
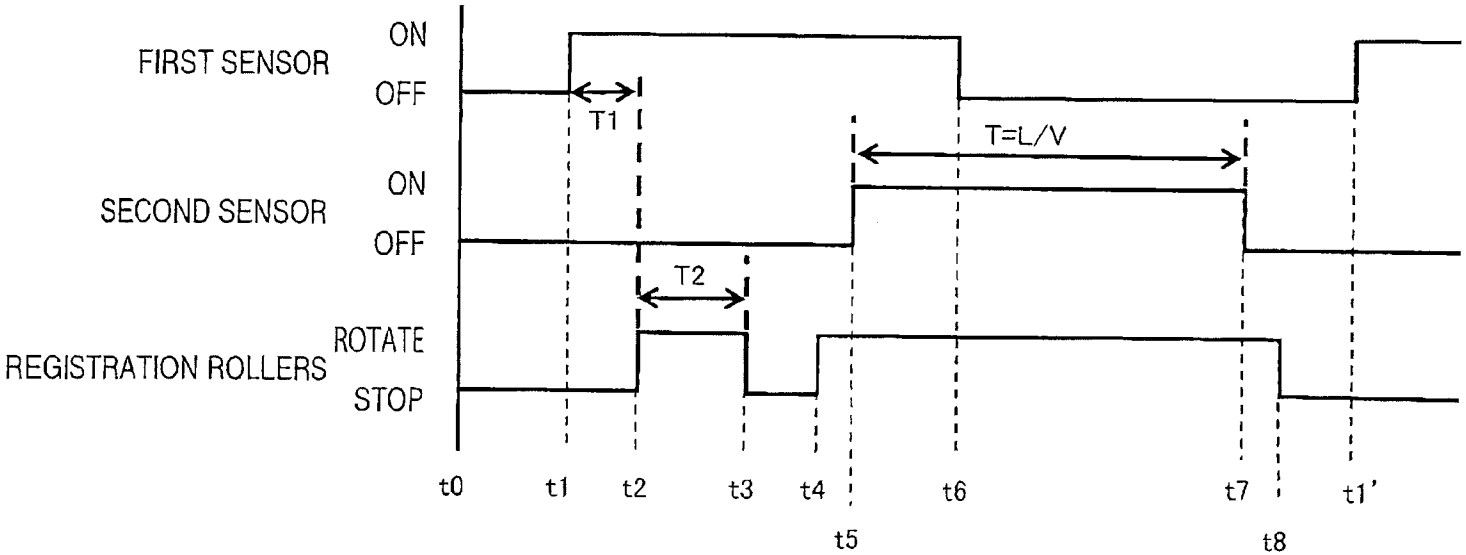
FIG. 6 is a diagram to illustrate behaviors of the first and second sensors and registration rollers while the sheet is inserted and conveyed in the printer according to the embodiment of the present invention.

Next, feeding and conveyance of the sheet 5 through the manual-feed conveyer path P2 will be described with reference to FIGS. 3 and 6. In FIGS. 3-6, positions of the sheets P are indicated in horizontal thick lines. Before the sheet 5 is fed, i.e., at a timing t0 in FIGS. 3 and 6, the first sensor S1 and the second sensor S2 output "off" signals, and the registration rollers 33 are inactive. When the user inserts a leading end of a sheet 5 in the manual-feed conveyer path P2 through the opening 12, at a timing t1 (see FIG. 6), the first sensor S1 detects the sheet 5 and is switched to output "on" signals. The registration rollers 33 start rotating at a timing t2 (see FIG. 6), after a predetermined time period T1 from t1. After a predetermined time period T2 from t2, at timing t3 (see FIGS. 3 and 6), the registration rollers 33 are stopped. During the predetermined time period T2, as the sheet 5 in the manual-feed conveyer path P2 forwarded beyond the first sensor S1 hits the registration rollers 33, the registration rollers 33 draw the first sheet 5 until the leading end of the first sheet 5 reaches an upstream position with respect to the second sensor S2. The rotation of the registration rollers 33 is stopped when the leading end of the first sheet 5 reaches the upstream position with respect to the second sensor S2.

While the sheet 5 is drawn by the registration rollers 33 to reach the upstream position with respect to the second sensor S2, the second sensor S2 outputs "off" signals. The timings to draw the sheet 5 by the registration rollers 33 and to stop the sheet 5 at the upstream position with respect to the sensor S2 are determined based on the signals from the first sensor S1.

The registration rollers 33 in the present embodiment serve to convey the sheet 5 and to register the timings of the sheet conveyance when the sheet 5 is fed. Therefore, when the sheet 5 is drawn by the registration rollers 33, and if print data has been received in the printer 10 from the information terminal device 100 through the network interface 89, at a timing t4 (see FIG. 6), the registration rollers 33 resumes conveying the sheet 5. When the leading end of the sheet 5 passes by the second sensor S2, at a timing t5 (see FIGS. 3 and 6), the second sensor S2 is switched to output "on" signals. Meanwhile, the image forming unit 40 starts forming an image with reference to the timing, at which the second sensor S2 is switched to "on" state, and prints the image on the sheet 5 being conveyed.

As the sheet 5 is conveyed by the registration rollers 33 and the conveyer belt 35 in the image forming unit 40, a tail end of the sheet 5 being conveyed passes by the first sensor S1, and the sheet 5 exits the detective range of the first sensor S1. The first sensor S1 is switched to output "off" signals at a timing t6 (see FIG. 6). Further, at a timing t7 (see FIGS. 3 and 6), when the tail end of the sheet 5 being conveyed passes by the second sensor S2, the sheet 5 exits the detective range of the second sensor S2, and the second sensor S2 is switched to output "off" signals. Thereafter, at a timing t8 (see FIG. 6), the registration rollers 33 are stopped. The image formed on the sheet 5 is thereafter thermally fixed by the fixing unit 50, and the sheet 5 is ejected by the ejection unit 60 to be released in the ejection tray 61. Once the rotation of the registration rollers 33 is stopped at the timing t8, if a second sheet 5 is correctly inserted in the manual-feed conveyer path P2 through the opening 12, from a timing t1' (see FIG. 6), the wave pattern along the timings t1-t8 shown in FIG. 6 is repeated.

A duration T of "on" signals for the second sensor S2 between the timing t5, at which the second sensor S2 is switched to output "on," and the timing t7, at which the second sensor S2 is switched to output "off," is equivalent to a period between a point, at which the leading end of the sheet 5 with the sheet length L passes by the second sensor S2, i.e., when the sheet 5 enters the detective range of the second sensor S2, and a point, at which the tail end of the sheet 5 passes by the second sensor S2, i.e., when the sheet 5 exits the detective range of the second sensor S2. In other words, while the sheet 5 is conveyed by the registration rollers 33 and the conveyer belt 35 at a conveying speed V, the duration T of "on" signals for the second sensor S2 is equal to the sheet length L divided by the conveying speed V (T=L/V).

4. Withdrawal of the Sheet

Behaviors of the sheet 5 being withdrawn from the manual-feed conveyer path P2 will be described with reference to FIGS. 4 and 7. When the sheet 5 inserted in the manual-feed conveyer path P2 and caught by the registration rollers 33 to be forwarded toward the image forming unit 40, the second sensor S2 is switched to output "on" signals. Thereafter, while the tail end of the sheet 5 is still protruding from the opening 12, the user may pull the tail end of the sheet 5 being inserted outward to withdraw the sheet 5 from the manual-feed conveyer path P2. In this regard, while the image fanning unit 40 is to start forming the image with reference to the timing, at which the second sensor S2 is switched to output "on" signals, the image forming unit 40 may continue to form the image even though the sheet 5 is no longer in the manual-feed conveyer path P2. Therefore, in order to avoid such "empty" image forming, when the sheet 5 is withdrawn, it is preferable that the image forming operation by the image forming unit 40 is stopped.

When the sheet 5 is manually inserted, and if print data has been received in the printer 10 from the information terminal device 100, at a timing t4 (see FIG. 7), the registration rollers 33 resume conveying the sheet 5. When the leading end of the sheet 5 being conveyed passes by the second sensor S2, at a timing t5 (see FIG. 7), the second sensor S2 is switched to output "on" signals. If the user starts pulling the sheet 5 outward, at a timing t9 (see FIGS. 4 and 7), the leading end of the sheet 5, which once entered the detective range of the second sensor S2, is pulled back toward the upstream side with respect to the second sensor S2. Therefore, the second sensor S2 is switched to output "on" signals. In this regard, at timing t10 (see FIGS. 4 and 7), while the leading end of the sheet 5 being pulled is beyond the first sensor S1 at the downstream side with respect to the first sensor S1 along the sheet conveying direction, the first sensor S1 remains outputting "on" signals. When the sheet 5 is pulled further outward, the leading end of the sheet 5 is pulled back in an upstream position with respect to the first sensor S1; therefore, at a timing t12 (see FIGS. 4 and 7), the first sensor S1 is switched to output "off" signals as well as the second sensor S2.

Thus, when the sheet 5 is correctly inserted in the manual-feed conveyer path P2, the first sensor S1 outputting "on" is switched to output "off", while the second sensor S2 outputting "on" continues to output "on" at the timing t6 (FIG. 6). On the other hand, when the sheet 5 is withdrawn backwards, the second sensor S2 outputting "on" is switched to output "off", while the first sensor S1 outputting "on" continues to output "on" at the timing t10 (FIG. 7). Therefore, based on the difference in the output signals from the first sensor S1 and the second sensor S2, judgment whether the sheet 5 is correctly inserted or withdrawn can be made. In particular, at the time when the second sensor S2 outputting "off" is switched output "on," if the first sensor S1 is outputting "off," it is determined that the sheet 5 is inserted correctly, and if the first sensor S2 is outputting "on," it may be determined that the sheet 5 is withdrawn.

5. Successive Insertion of Sheets and Making a Judgment

Figure 8:
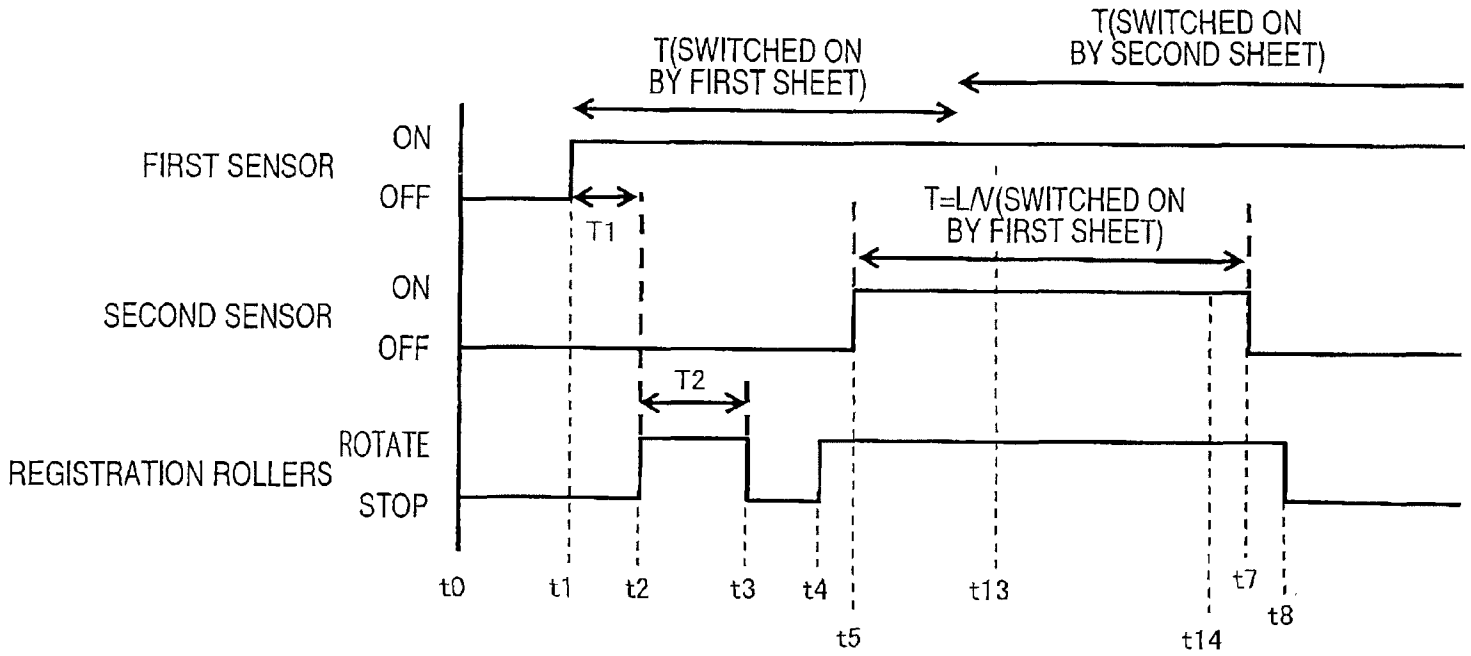
FIG. 8 is a diagram to illustrate behaviors of the first and second sensors and the registration rollers while the sheets are successively inserted and conveyed in the printer according to the embodiment of the present invention.

However, in addition to correct insert of the sheet 5 and withdrawal of the sheet 5, there may be a case that a user inserts two or more sheets successively in the manual-feed conveyer path P2. In particular, the user may insert a first sheet 5A, and without waiting for a sufficient length of period, a second sheet 5B in the manual-feed conveyer path P2 (see FIGS. 5 and 8). In the case of such successive insert without the sufficient waiting period, the second sheet 5B may be inserted through the opening 12 to reach the detective range of the first sensor S1 before the tail end of the first sheet 5A being conveyed exits the detective range of the first sensor S1 and before the first sensor S1 is switched to output "off" at a timing t13 (FIGS. 5 and 8). In this regard, the first sensor S1 is maintained "on" without being switched to "off" after the leading end of the first sheet 5A passes by the first sensor S1 at the timing t1 (FIG. 8). While, at a timing 14 (FIG. 8), the second sheet 5B is held by the user at the position to switch the first sensor S1 to output "on" signals, when the tail end of the first sheet 5A being conveyed by the registration rollers 33 toward the image forming unit 40 passes by the second sensor S2, at a timing t7 (FIGS. 5 and 8), the second sensor S2 is switched to output "off" signals.

Therefore, when the sheets 5A, 5B are inserted successively, as well as the case when the sheet 5 is withdrawn, the first sensor S1 outputting "on" continues to output "on", and the second sensor S2 outputting "on" is switched to output "off." In other words, in either case, while the second sensor S2 outputting "on" is switched to output "off," the first sensor S1 continues to output "on." Thus, difference between the withdrawal and the successive insertion of the sheets 5 cannot be distinguishably recognized from the behavior of the first and second sensors S1, S2.

In the case of successive insertion, however, the second sensor S2 continues to output "on" between the timing t5 (FIGS. 5 and 8), when the leading end of the first sheet 5A being forwarded passes by the second sensor S2, and the timing t7 (FIGS. 5 and 8), when the tail end of the first sheet 5A being forwarded passes by the second sensor S2. Therefore, upon successive insertion of the sheets 5A, 5B, the second sensor S2 continues to output "on" while the first sheet 5A is forwarded to enter the detective range of the second sensor S2, and the duration T of "on" signals for the second sensor S2 is equivalent to a length of period corresponding to the sheet length L of the sheet 5A. On the other hand, when the sheet 5 is withdrawn, the duration T of "on" signals for the second sensor S2 depends on the timing of withdrawal (see FIG. 7). The duration T of "on" signals for the second sensor S2 may be referred to as "presence-detecting duration T" hereinafter. Thus, the presence-detecting duration T differs between the successive insertion of the sheets 5A, 5B and the withdrawal of the sheet 5.

Based on the behaviors of the second sensor S2, the sheet length L of the sheet 5 and the presence-detecting duration T of the second sensor S2 with reference to a conveying speed V to convey the sheet 5 are represented in following formulas.

$$L=T*V \qquad \text{Formula 1}$$

$$\Delta=|Lo-L|,\ \Delta<K \qquad \text{Formula 2}$$

Based on the formulas, it is determined whether the sheets 5A, 5B are being successively inserted or the sheet 5 is being withdrawn by comparing the sheet length L of the currently conveyed sheet 5 obtained from the formulas and the sheet length Lo of the assumed-sized sheet, which is, for example, 297 mm. In particular, when an absolute value of a difference Δ between the sheet length Lo of the assumed-sized sheet and the sheet length L of the currently conveyed sheet 5 obtained from Formula 1 is smaller than a threshold K, while K is greater than zero (K>0), it is determined that it is the sheet 5B being inserted successively following the preceding sheet 5A. On the other hand, when the absolute value of the difference Δ is greater than or equal to the threshold K, it is determined that the current sheet 5 is being withdrawn.

If it is determined that the current sheet 5 is being withdrawn, conveyance of the current sheet 5 by the sheet conveyer 30 and image forming by the image forming unit 40 is stopped. On the other hand, if it is determined that it is the sheet 5B being successively inserted, conveyance of the sheet 5B by the sheet conveyer 30 and image forming by the image forming unit 40 is maintained.

In the present embodiment, the sheet length Lo of the assumed-sized sheet includes a sheet length L1, which is a length of a sheet 5 having been inserted in the manual-feed conveyer path P2 and conveyed successfully by the registration rollers 33 in previous conveyance, and a sheet length L2, which is obtained from the print data to be used with the current sheet 5 in the current conveyance. With the two patterns of sheet lengths L1, L2, whether the current sheet 5 is the sheet 5B being inserted successively to the sheet 5A or the sheet 5 being withdrawn is determined by comparing the sheet length L of the current sheet 5 obtained from the formulas and one of the predetermined sheet lengths L1, L2.

6. Judging Sequence

Figure 9:
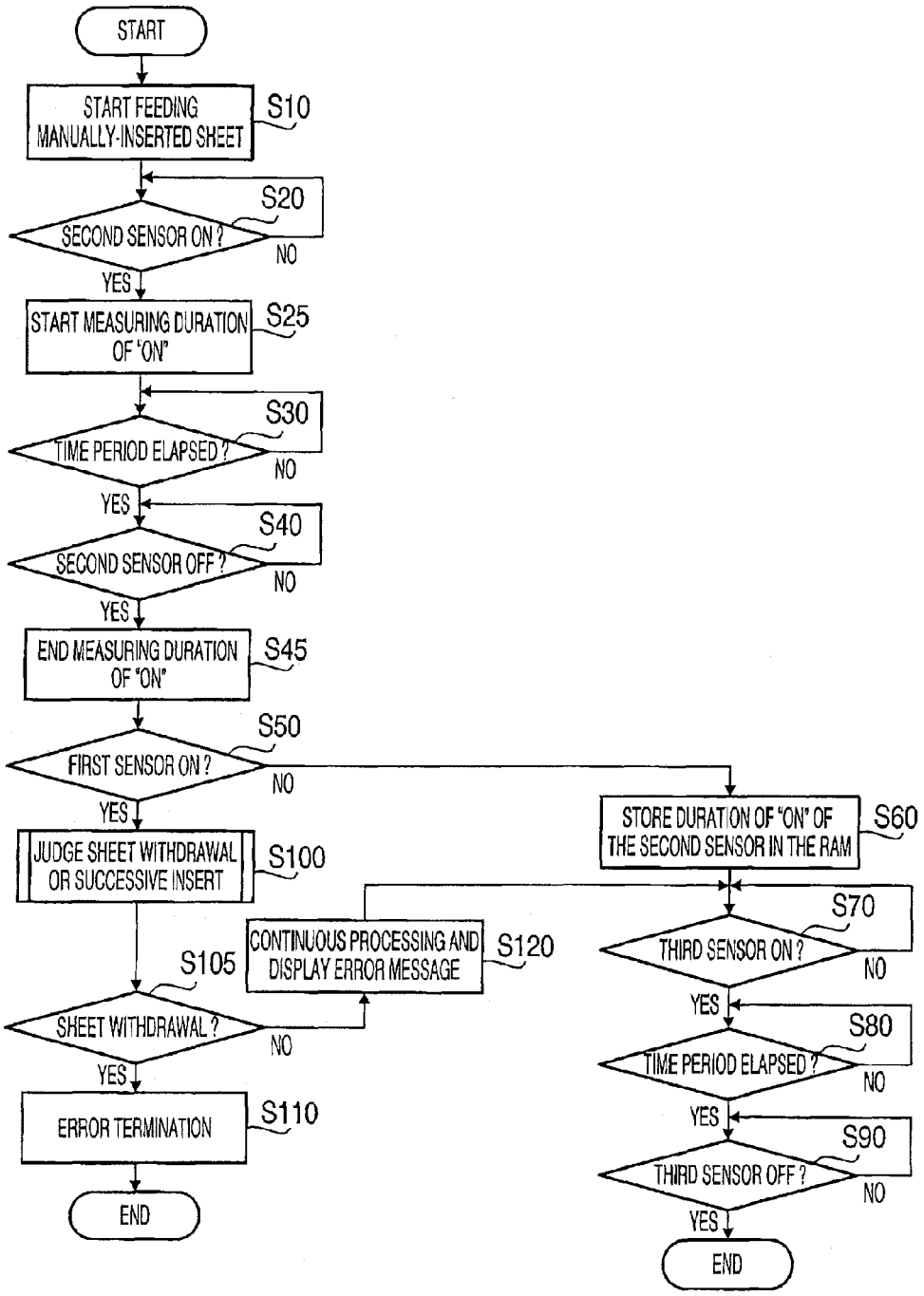
FIG. 9 is a flowchart to illustrate a sequence of judgment making in the printer according to the embodiment of the present invention.
Figure 10:
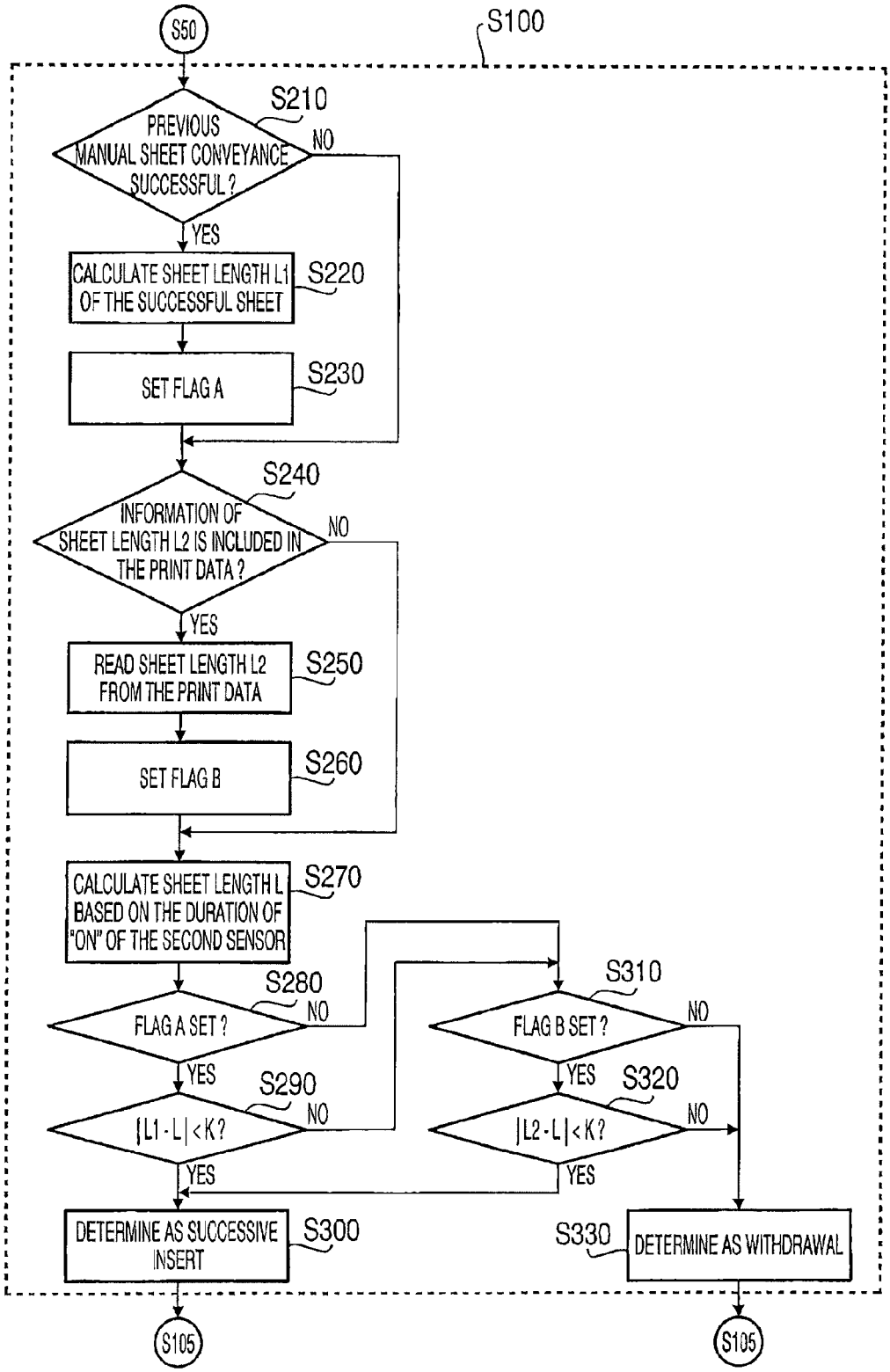
FIG. 10 is a flowchart to illustrate S100 in the judgment making to be executed in the printer according to the embodiment of the present invention.

A sequence of making a judgment between withdrawal and successive insert of the sheets 5 based on the behaviors of the printer 10 will be described with reference to FIGS. 9 and 10. The sequence of judging is initiated when the user inserts a current sheet 5 in the manual-feed conveyer path P2 and when the first sensor. S1 is switched to output "on" signals.

When the first sensor S1 detects presence of the current sheet 5 in the manual-feed conveyer path P2 and is switched to output "on" signals (t1 in FIGS. 6-8), and after a predetermine time period T1 (t2 in FIGS. 6-8), the registration rollers 33 start rotating. The registration rollers 33 continue rotating for the predetermined time period T2 (t3 in FIGS. 6-8) to convey the current sheet 5 to the upstream position with respect to the second sensor S2. Then, in S10, the controller 80 starts conveying the current sheet 5 by rotating the registration rollers 33 (t4 in FIGS. 6-8) if the print data has been received from the information terminal device 100 through the network interface 89.

The controller 80 monitors the behavior of the second sensor S2, and in S20, the controller 80 judges whether the second sensor S2 outputs "on" signals. When the leading end of the current sheet 5 being forwarded passes by the second sensor S2, the second sensor S2 outputs "on" signals (t5 in FIGS. 6-8). Based on the output signals from the second sensor S2, an affirmative judgment is made in S20 (S20: YES).

Figure 7:
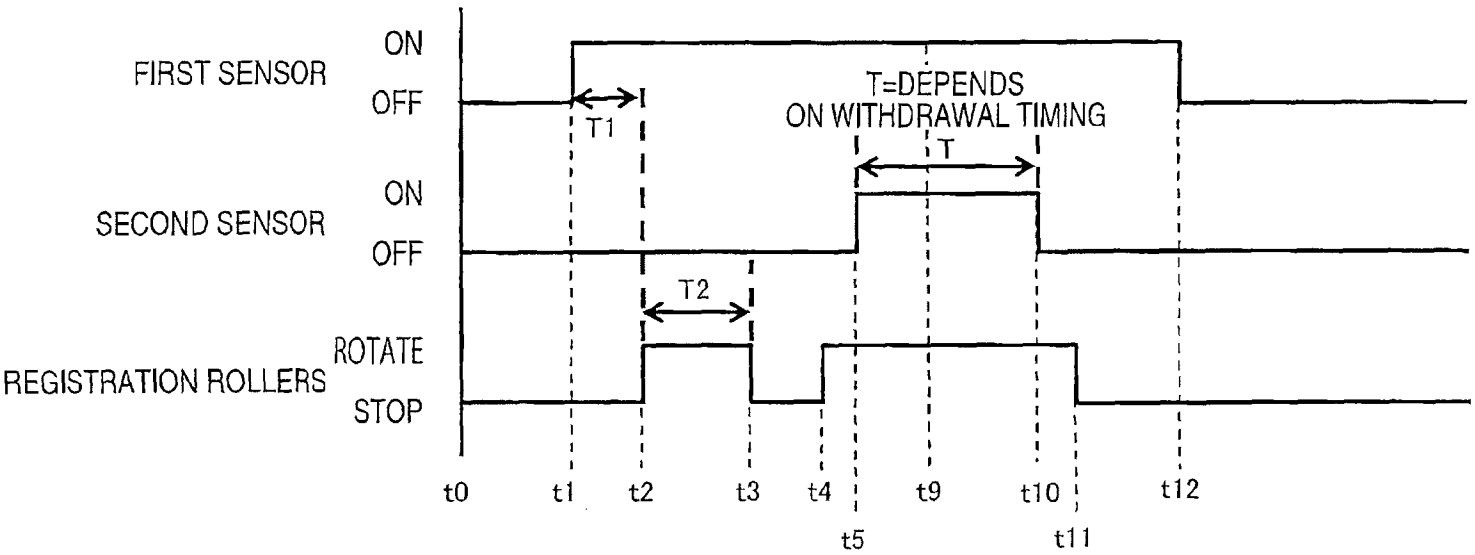
FIG. 7 is a diagram to illustrate behaviors of the first and second sensors and the registration rollers while the sheet is inserted in and withdrawn from the printer according to the embodiment of the present invention.

In S25, the controller 80 activates the timer 87 to measure the presence-detecting duration T of the second sensor S2 (t5 in FIGS. 6-8). In S30, when the predetermined time period elapsed (S30: YES), in S40, the controller 80 monitors the behavior of the second sensor S2 to determine whether the second sensor S2 outputs "off" signals. The procedure of S30 is provided in order to wait until the second sensor S2 is stabilized and avoid erroneous detection due to chattering of the second sensor S2.

As the current sheet 5 is conveyed toward the downstream side by the registration rollers 33 and the conveyer belt 35, the tail end of the current sheet 5 passes by the second sensor S2, and the current sheet 5 exits the detective range of the second sensor S2.The second sensor S2 outputting "on" signals is switched to output "off" signals. The controller 80 detects the output signals from the second sensor S2 and makes affirmative judgment in S40 (S40: YES). In S45, the controller 80 stops the timer 87 to obtain the presence-detecting duration T of the second sensor S2 (t7 in FIGS. 6 and 8, t10 in FIG. 7).

In S50, the controller 80 monitors the output signals from the first sensor S1 and judges whether the first sensor S1 outputs "on" signals.

In this regard, if the current sheet 5 is the second sheet 5B following the first sheet 5A, and the second sheet 5B is correctly inserted after the sufficient length of time, when the tail end of the first sheet 5A passes by the second sensor S2 (t7 in FIGS. 3, 6), the second sheet 5B is not yet inserted in the manual-feed conveyer path P2. In this case, the first sensor S1 outputs "off" signals, and negative judgment is made in S50 (S50: NO). The flow proceeds to S60.

In S60, the controller 80 stores the presence-detecting duration T of the second sensor S2 measured through S25-S45 in the RAM 85. If any presence-detecting duration T from a past operation is in the RAM 85, the current presence-detecting duration T replaces the older presence-detecting duration.

As the controller 80 monitors the outputs from the first and second sensors S1, S2, the current sheet 5 is forwarded by the conveyer belt 34 toward further downstream to have an image formed thereon by the image forming unit 40. The current sheet 5 is further conveyed to and beyond the fixing unit 50 to reach the third sensor S3.

In S70, the controller 80 monitors the output from the third sensor S3 and judges whether the third sensor S3 outputs "on" signals. When the leading end of the current sheet 5 being conveyed passes by the third sensor S3, the third sensor S3 outputs "on" signals. Based on the output signals from the third sensor S3, an affirmative judgment is made in S70 (S70: YES). When a predetermined time period elapsed in S80 (S80: YES), in S90, the controller 80 monitors the behavior of the third sensor S3 to determine whether the third sensor S3 outputs "off" signals. The procedure of S80 is provided, as well as S30, in order to wait until the third sensor S3 is stabilized and avoid erroneous detection due to chattering of the third sensor S3.

When the tail end of the current sheet 5 being forwarded passes by the third sensor S3, the third sensor S3 is switched to output "off" signals, and thereby, an affirmative judgment is made in S90 (S90: YES). The conveyer belt 35 in the sheet conveyer 30, the fixing unit 50, and the ejection rollers 63 are driven continuously for a predetermined period, and when the current sheet 5 is ejected by the ejection unit 60 in the ejection tray 61, the conveyer belt 35, the fixing unit 50, and the ejection rollers 63 are stopped.

Meanwhile, if the current sheet 5 is being withdrawn or the current sheet 5 is the second sheet 5B being successively inserted, as has been mentioned above, the first sensor S1 stays "on" while the second sensor S2 is switched from "on" to output "off" signals (t10 in FIG. 7, t7 in FIG. 8). Therefore, affirmative judgment is made in S50 (S50: YES), and the sequence proceeds to S 100. In S100, the controller 80 judges whether the current sheet 5 is the sheer 5 being withdrawn or the second sheet 5B being successively inserted based on the presence-detecting duration T of the second sensor S2.

The judgment in S100 is made based on comparison between the sheet length L of the current sheet 5, which is obtained from the presence-detecting duration T of the second sensor S2, and the sheet length L1 of a previous sheet 5, which was successfully conveyed through the manual-feed conveyer path P2 in previous conveyance, or the sheet length L2, which is obtained from information included in the current print data. The judgment in S100 includes S210-S330, which are in a flowchart shown in FIG. 10. In the following description, it is assumed that flags A, B are cleared before the flow starts.

In S210, it is judged whether the previous conveyance of the previous sheet 5 inserted in the manual-feed conveyer path P2 has been successfully completed. The judgment may be made by, for example, referring to a history concerning the past conveyance of sheets 5, and successful conveyance of the previous sheet 5 may be determined if the manually-inserted sheet 5 has exited the detective range of the second sensor S2 and has been detected by the third sensor S3.

If the previous conveyance was successfully completed (S210: YES), the flow proceeds to S220. In S220, the controller 80 obtains the sheet length L1 of the previously successfully conveyed sheet 5. The sheet length L1 of the previously successfully conveyed sheet 5 may be obtained based on the following formula.

$$L1=Tr*V+\alpha \qquad \text{Formula 3}$$

In the above Formula 3, Tr represents the presence-detecting duration T of the second sensor S2 stored in the RAM 85 in S60 (see FIG. 9) in the previous conveying sequence. In other words, Tr represents the presence-detecting duration T of the second sensor S2 measured with the successfully conveyed sheet 5 in the previous conveyance. V represents the conveying speed of the sheet 5, and a represents a correction value.

The correction value $\alpha$ corrects an error which may be included in the presence-detecting duration T of the second sensor S2. For example, when the second sensor S2 is an optical sensor including a photo-interrupter and a light blocker, which swings in response to the sheet 5 passing by, a position of the light-blocker when the photo-interrupter is switched on is different from a position of the light-blocker when the photo-interrupter is switched off. While the photo-interrupter is moved from the "on" position to the "off" position, and vice versa, time lags for the transient motion are created. Therefore, the time lags should be compensated by the correction value $\alpha$.

In S220, the sheet length L1 of the previously conveyed sheet 5 is obtained, and the flow proceeds to S230. In S230, a flag A is set on, and the flow proceeds to S240. If the previous conveyance was not successful (S210: NO), S220 and S230 are omitted, and the flow proceeds to S240 without setting the flag A. The flag A is referred to later in order to judge whether the previous conveyance was successfully completed. If the previous conveyance was not completed successfully, the sheet length L1 cannot be calculated; therefore, S220 and S230 are omitted.

In S240, it is judged whether the print data from the information terminal device 100 received in the printer 10 includes information concerning the sheet length L2 for the current sheet 5. If the information is included (S240: YES), the flow proceeds to S250. In S250, the sheet length L2 for the current sheet 5 being conveyed is extracted from the print data.

When the sheet length L2 is extracted, the flow proceeds to S260, and the flag B is set on. The flow proceeds to S270. If the print data does not include the information concerning the sheet length L2 (S240: NO), S250 and S260 are omitted, and the flow proceeds to S270 without setting the flag B. The flag B is referred to later in order to judge whether the print data included the information concerning the sheet length L2.

In S270, the controller 80 calculates the sheet length L of the current sheet 5 based on the presence-detecting duration T of the second sensor S2. The sheet length L is obtained based on the following Formula 4.

$$L=T*V+\alpha \quad \text{Formula 4}$$

In the above equation 4, T represents the presence-detecting duration T for the current sheet 5 in the detective range of the second sensor S2 measured by the timer 87. V represents the conveying speed of the sheet 5, and α represents the correction value.

When the sheet length L of the current sheet 5 is obtained in S270, in S280, the obtained sheet length L is compared with the sheet length L1 or the sheet length L2 in order to determine whether the current sheet 5 is the sheet 5 being withdrawn or the sheet 5B inserted successively to the sheet 5A.

In particular, in S280, the controller 80 judges whether the flag A is set on. If the flag A is set on, that is, if the previous conveyance was successfully completed (S280: YES), in S290, the sheet length L obtained from the presence-detecting duration T for the current sheet 5 is compared with the sheet length L1 of the successfully conveyed sheet 5. Based on the comparison, the controller 80 determines whether the sheet length L of the current sheet 5 is substantially equal to the sheet length L1. In particular, it is judged whether the following condition is met.

$$|L1-L|<K \quad \text{Formula 5}$$

In the above Formula 5, L represents the sheet length of the current sheet 5 obtained based on the presence-detecting duration T. L1 represents the sheet length of the successfully conveyed sheet 5 in the previous conveyance. K represents the threshold, which is an allowance for the sheet lengths L and L I are a same length.

When the condition of Formula 5 is satisfied, i.e., when the absolute value of the difference between the sheet length L1 of the successfully conveyed sheet 5 in the previous conveyance and the sheet length L of the current sheet 5 obtained from the presence-detecting duration T is within an extent of the threshold K (S290: YES), it is determined that the sheet length L of the current sheet 5 is the same as the sheet length L1 of the successfully conveyed sheet 5. In other words, it is determined that the sheet length L of the current sheet 5 is equal to the reference sheet length Lo of the assumed-sized sheet. When the sheet length L of the current sheet 5 is substantially equal to the reference sheet length Lo (S290: YES), in S300, it is determined that the current sheet 5 is the sheet 5B being inserted successively to the previously successfully conveyed sheet 5 being the sheet 5A. Upon judging in S290, a reason to determine that the current sheet 5 is the successively inserted sheet 5B, rather than the sheet 5 being withdrawn, based on the equality with the sheet length L1 of the previously successfully conveyed sheet 5, is that: if two sheets 5 are inserted successively to be used for printing in the printer 10, it is likely that the two sheets 5 are in the same size. In other words, it is unlikely that different-sized two sheets 5 are inserted successively to be used. Thus, in S300, it is determined that the current sheet 5 is the successively inserted sheet 5B.

Meanwhile, in S280, if the flag A is not set on (S280: NO), or in S290, if the condition of the Formula 5 is not satisfied (S290: NO), the flow proceeds to S310. In S310, the controller 80 judges whether the flag B is set on.

If the flag B is set on (S310: YES), in S320, the sheet length L obtained from the presence-detecting duration T is compared with the sheet length L2 extracted from the information contained in the print data. Based on the comparison, the controller 80 determines whether the sheet length L of the current sheet 5 is substantially equal to the sheet length L2. In particular, it is judged whether the following condition is met.

$$|L2-L|<K \quad \text{Formula 6}$$

In the above Formula 6, L represents the sheet length of the current sheet 5 obtained based on the presence-detecting duration T. L2 represents the sheet length obtained from the print data. K represents the threshold, which is an allowance for the sheet lengths L and L2 are a same length.

When the condition of Formula 6 is satisfied, i.e., when the absolute value of the difference between the sheet length L2 obtained from the print data and the sheet length L of the current sheet 5 obtained from the presence-detecting duration T is within an extent of the threshold K (S320: YES), it is determined that the sheet length L of the current sheet 5 is the same as the sheet length L2 extracted from the print data. The flow proceeds to S300, and it is determined that the sheet 5 is the sheet 5B inserted successively to the sheet 5A.

In S320, if the condition of Formula 6 is not satisfied (S320: NO), it is determined that the sheet length L of the current sheet 5 and the sheet length L2 extracted from the print data are not the same. The flow proceeds to S330, and it is determined that the sheet 5 is being withdrawn. In S310, if the flag B is not set (S310: NO), the flow also proceeds to S330, and it is determined that the sheet 5 is being withdrawn.

According to the judging flow described above, when the sheet length L obtained from the presence-detecting duration T equates to one of the sheet length L1 of the successfully conveyed previous sheet 5 and the sheet length L2 contained in the print data, it is judged that the current sheet 5 is the sheet 5B being inserted successively. On the other hand, when the sheet length L of the current sheet 5 equates neither of the sheet length L 1 nor the sheet length L2, it is judged that it is withdrawal of the current sheet 5. The flow completes S100 and proceeds to S105 (FIG. 9).

In S105, the controller 80 judges whether it was determined in S100 that the sheet 5 is being withdrawn. If it was determined that the sheet 5 is being withdrawn (S105: YES), the sequence proceeds to S110, and the controller 80 stops the printer 10. In particular, conveyance of the current sheet 5 by the registration rollers 33 and the conveyer belt 35 is stopped, and image forming by the image forming unit 40 is stopped (t10 in FIG. 4 and t11 in FIG. 7). Thus, empty image forming operation can be prevented from being conducted when no sheet 5 is supplied in the printer 10.

In S105, if the controller 80 judges it was determined in S100 that the current sheet 5 is the sheet 5B being inserted successively (S105: NO), the flow proceeds to S120. In S120, the controller 80 executes a continuous processing, in which conveyance of the preceding sheet 5A by the conveyer belt 35 in the sheet conveyer 30 and image forming by the image forming unit 40 is continued. Accordingly, an image is formed on the preceding sheet 5A, and the preceding sheet 5A is forwarded to the fixing unit 50 and ejected by the ejection unit 60 to be disposed in the ejection tray 61. In S120, further, the controller 80 manipulates the display unit 93 to display an error-indicating message such as "Please place the sheet back in the manual-feed conveyer path" in order to have the successively inserted sheet 5B to be inserted correctly after the sufficient time period.

7. Effects

According to the embodiment described above, withdrawal of the sheet 5 from the manual-feed conveyer path P2 and successive insertion of the sheet 5 in the manual-feed conveyer path P2 can be distinguishably recognized. When the current sheet 5 is the sheet 5B inserted successively to the sheet 5A, conveyance of the sheet 5A by the sheet conveyer 30 and image forming by the image forming unit 40 is maintained in the continuous processing. Therefore, between the preceding sheet 5A and the successive sheet 5B, the image is formed at least on the preceding sheet 5A. Thus, efficiency in image forming with the manually-inserted sheets 5 can be improved. On the other hand, when the sheet 5 is being withdrawn, image forming in the printer 10 is terminated. Therefore, an empty image fanning operation, with no sheet 5 in the printer 10, can be prevented.

According to the embodiment, the second sensor S2 is arranged in the upstream position with respect to the image forming unit 40 along the conveying direction of the sheet 5 (e.g., on the left-hand side in FIG. 1). Therefore, compared to a configuration, in which the second sensor S2 is arranged in a downstream position with respect to the image forming unit 40 along the conveying direction, the judgment in S100 can be made in an earlier stage after conveyance of the sheet 5 starts. Accordingly, when judgment is made that the sheet 5 is being withdrawn, the image forming operation by the image forming unit 40 can be stopped in an earlier stage, and the image forming operation can be prevented from being continued vainly.

According to the embodiment, the image forming operation by the image forming unit 40 is activated with reference to the timing, at which the second sensor S2 starts outputting "on" signals. In other words, the timing to start the image forming operation depends on the output of the second sensor S2. While it is important to start the image forming operation in a correct timing, a sensitive sensor is required for the second sensor S2. According to the present embodiment, the sheet length L of the sheet 5 is calculated based on the presence-detecting duration T obtained by the sensitive second sensor S2. Therefore, an accurate sheet length L can be obtained, and it can be accurately judged whether the sheet length L of the sheet 5 obtained based on the presence-detecting duration T equates to the sheet length L1 or the sheet length L2.

According to the embodiment, the distance L23 (FIG. 3) between the second sensor S2 and the third sensor S3 is greater than the reference sheet length Lo of the assumed-sized sheet. If the distance L23 is greater than the reference sheet length Lo, as it is in the embodiment described above, and when the sheet 5 being forwarded passes by the second sensor S2, the third sensor S3 outputs "off" signals. Therefore, the judgment, whether the sheet 5 is being withdrawn or is inserted successively to the previous sheet, cannot be made based on the outputs of the third sensor S3. Meanwhile, in the present embodiment, even with the distance L23 between the second sensor S2 and the third sensor S3 being greater than the reference sheet length Lo of the assumed-sized sheet, the judgment between withdrawal or successive insertion can be distinguishably recognized based on the difference between the sheet length L of the currently conveyed sheet 5 and the sheet length Lo of the assumed-sized sheet calculated from the presence-detecting duration T of the second sensor.

According to the embodiment, the sheet length L1, which is the length of the sheet 5 inserted in the manual-feed conveyer path P2 and conveyed successfully by the registration rollers 33 previously, and the sheet length L2, which is obtained from currently usable print data, are prepared for the reference sheet length Lo. Based on the sheet length L2, which is extracted from the print data, the sheet length L of the current sheet 5 can be assumed effectively. Meanwhile, based on the sheet length L1 of the successfully conveyed previous sheet 5, the sheet 5 being currently conveyed is provided with the reference sheet length Lo even when no information concerning the sheet length L2 is contained in the print data or when the sheet length L2 contained in the print data is different from the sheet length L of the current sheet 5.

Second Embodiment

Next, a second embodiment according to the invention will be described. It is noted in the first embodiment that the presence-detecting duration T of the second sensor S2 is converted into the sheet length L of the current sheet 5, and the obtained sheet length L is compared with the reference sheet length L1 or L2 in order to judge whether the sheet 5 is being withdrawn or being inserted successively to the previous sheet 5. However, the judgment may not necessarily be based on the converted sheet length L. In the second embodiment, the judgment is made based on comparison between the presence-detecting duration T of the second sensor S2 and a predetermined prospective presence-detectable duration To.

In particular, the prospective presence-detectable duration To, which is assumed based on the sheet length Lo of the assumed-sized sheet to be conveyed, is obtained from a following Formula 7.

$$To=Lo/V \qquad \text{Formula 7}$$

$$\Delta=|To-T|,\ \Delta<K \qquad \text{Formula 8}$$

Based on the formulas, it is determined that the sheet 5 is the sheet 5B inserted successively to the sheet 5A when an absolute value of a difference Δ between the measured presence-detecting duration T and the prospective presence-detectable duration To is smaller than the threshold K, while K is greater than zero (K>0). On the other hand, when the absolute value of the difference Δ is greater than or equal to the threshold K, it is determined that the sheet 5 is being withdrawn.

More Examples

Although examples of carrying out the invention have been described, those skilled in the art will appreciate that there are numerous variations and permutations of the printer or the sheet conveyer that fall within the spirit and scope of the invention as set forth in the appended claims. It is to be understood that the subject matter defined in the appended claims is not necessarily limited to the specific features or act described above. Rather, the specific features and acts described above are disclosed as example fauns of implementing the claims.

Figure 11:
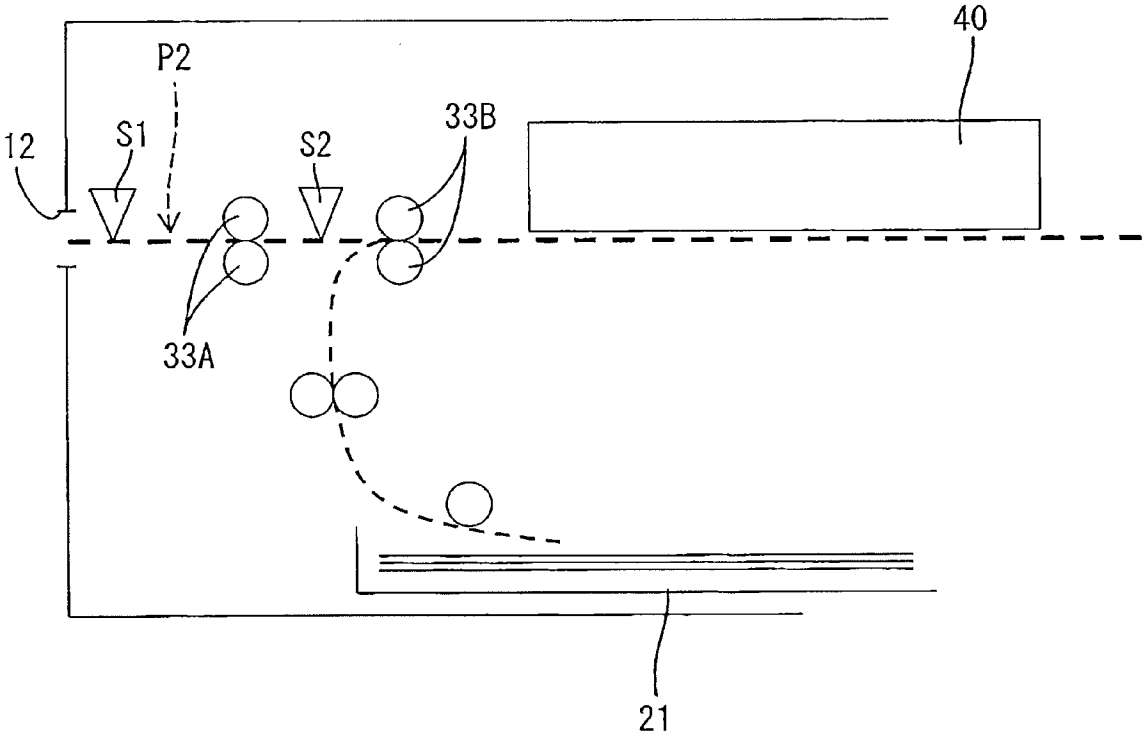
FIG. 11 is a cross-sectional view of a sheet conveying device according to a second embodiment of the present invention.

For example, in the above embodiments, the registration rollers 33 serve to convey the sheet 5 and to register the timings of the sheet conveyance when the sheet 5 is manually inserted. However, the printer 10 may not necessarily be configured to have the registration rollers 33 or other components as described in the above embodiments. For example, as shown in FIG. 11, the two functions of the registration rollers 33 may be separately assigned to conveying rollers 33A, for conveying the sheet 5, and registering rollers 33B, for registering the timing Further, the second sensors S2 may be arranged in a downstream position with respect to the conveying rollers 33A. In other words, the second sensor S2 may not necessarily be arranged in the downstream position with respect to the registering rollers 33B as long as the second sensor S2 is arranged in a downstream position with respect to a conveying member (e.g., the rollers 33A in FIG. 11), which forwards the sheet 5 having passed by the first sensor S1.

For another example, the present invention may not necessarily be applied to the direct tandem-typed color laser printer 10, which transfers multi-colored developer agents directly onto the sheet 5 being conveyed. The present invention may be similarly effectively applied to other image forming apparatuses, such as an intermediate transfer-typed color laser printer 200 (FIG. 12), which transfers multi-colored developer agents indirectly onto a sheet via an intermediate transfer belt 210.

Figure 12:
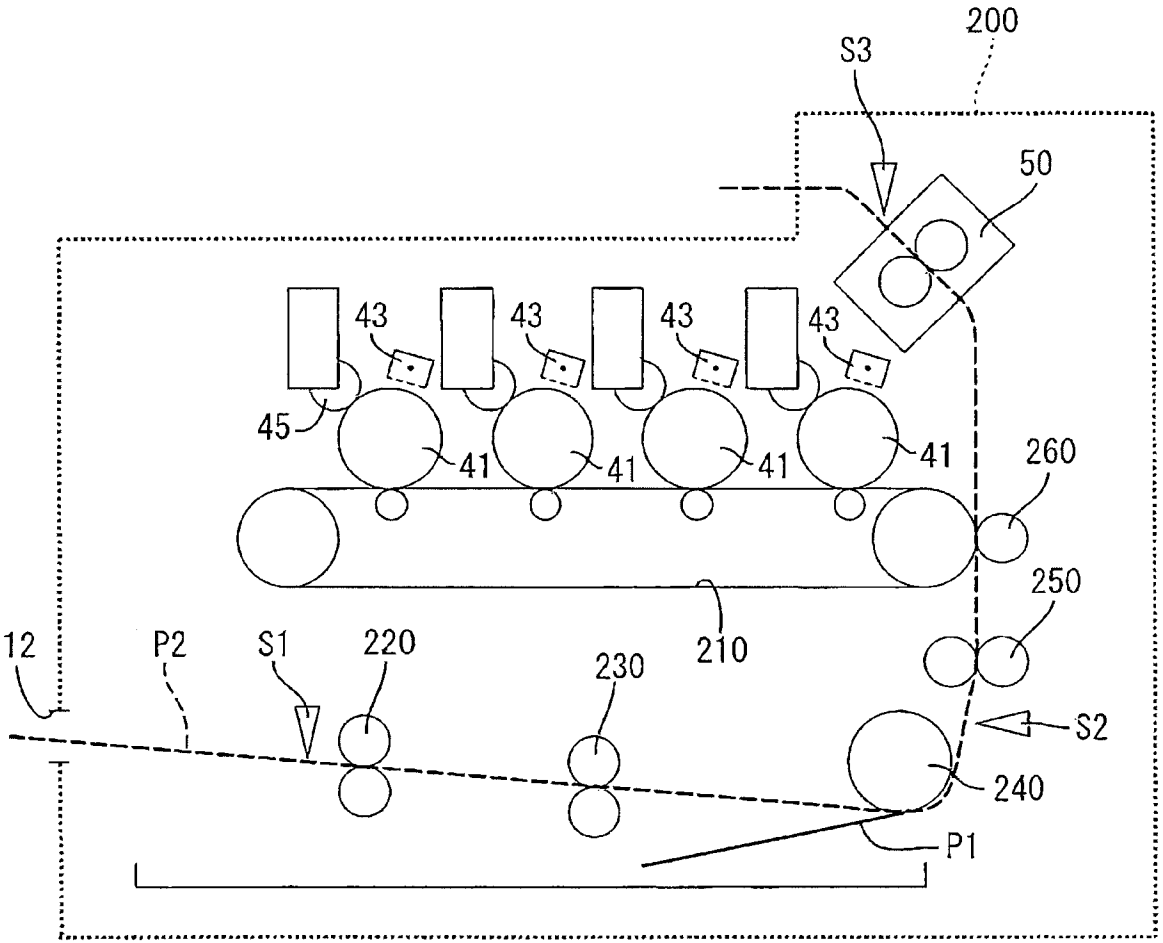
FIG. 12 is a cross-sectional side view of a printer according to a third embodiment of the present invention.

In FIG. 12, it is to be noted that signs 220, 230 denote conveyer rollers for conveying the sheet inserted through the opening 12 into the manual-feed conveyer path P2, and a sign 240 denotes a pickup roller. Further, a sign 250 denotes a registration roller, and a sign 260 denotes a secondary transfer roller for transferring a colored image onto the sheet. In the example shown in FIG. 12, the first sensor S1 is arranged along the manual-feed conveyer path P2, and the second sensor S2 is arranged in a position between the pickup roller 240 and the registration roller 250.

In the embodiments described above, the printer 10 is provided with the controller 80 including the single CPU 81, the ROM 83, and the RAM 85. However, for example, the controller 80 may be equipped with a plurality of CPUs 81. For another example, the controller 80 may be a combination of the CPU 81 and a hardware circuit such as an ASIC. Further, the controller 80 may be configured with a hardware circuit alone.

In the first embodiment described above, the sheet length L of the sheet 5 obtained from the presence-detecting duration T is compared with the reference sheet length Lo, which includes the sheet length L1 of the successfully conveyed previous sheet 5 and the sheet length L2 contained in the print data. However, the sheet length L may not necessarily be compared with the two sheet lengths L1, L2. The sheet length Lo may not necessarily have two reference lengths but may have a single reference length to be compared with the sheet length L.

What is claimed is:

1. A sheet conveyer, comprising:

a manual-feed conveyer path, in which a sheet is inserted manually and conveyed along a sheet conveying direction;

a first sensor arranged along the manual-feed conveyer path and configured to detect presence of the sheet inserted in the manual-feed conveyer path;

a registration roller configured to align the sheet in a correct orientation and configured to convey the sheet having passed by the first sensor toward a downstream side along the sheet conveying direction;

an image forming unit configured to form an image on the sheet and configured to convey the sheet conveyed by the registration roller further toward the downstream side along the sheet conveying direction;

a second sensor arranged along the manual-feed conveyer path in a downstream position with respect to the registration roller along the sheet conveying direction and configured to detect presence of the sheet in the downstream position with respect to the registration roller, the second sensor being switchable between a presence-detectable state, in which the second sensor detects presence of the sheet, and an absence-detectable state, in which the second sensor detects absence of the sheet; and a controller configured to:

measure presence-detecting duration of the second sensor, which starts when the second sensor is switched from the absence-detectable state to the presence-detectable state and ends when the second sensor is switched from the presence-detectable state to the absence-detectable state;

calculate a value based on the measured presence-detecting duration of the second sensor;

control the image forming unit to stop conveying the sheet if the first sensor is detecting presence of the sheet when the second sensor is switched from the presence-detectable state to the absence-detectable state, and if a difference between the value calculated based on the measured presence-detecting duration of the second sensor and a reference value obtained based on a reference sheet length of an assumed sheet along the sheet conveying direction is equal to or larger than a predetermined threshold; and control the image forming unit to continue conveying the sheet if the first sensor is detecting presence of the sheet when the second sensor is switched from the presence-detectable state to the absence-detectable state, and if the difference between the value calculated based on the measured presence-detecting duration of the second sensor and the reference value obtained based on the reference sheet length of the assumed sheet along the sheet conveying direction is smaller than the predetermined threshold.

2. The sheet conveyer according to claim 1, wherein the controller is configured to judge that the sheet is being withdrawn if the measured presence-detecting duration of the second sensor is one of greater than and equal to a reference duration corresponding to the reference sheet length of the assumed sheet along the sheet conveying direction.

3. The sheet conveyer according to claim 2, wherein the controller is configured to control the image forming unit to stop conveying the sheet when judgment is made that the sheet is being withdrawn.

4. The sheet conveyer according to claim 1, wherein the controller is configured to judge that the sheet is being withdrawn if the value calculated based on the measured presence-detecting duration of the second sensor representing a sheet length of the manually inserted sheet is one of greater than and equal to the reference sheet length of the assumed sheet along the sheet conveying direction.

5. The sheet conveyer according to claim 4, wherein the sheet length of the manually inserted sheet is calculated based on the measured presence-detecting duration of the second sensor and a conveying speed of the sheet; and wherein the controller is configured to control the image forming unit to continue conveying the sheet if the first sensor is detecting presence of the sheet when the second sensor is switched from the presence-detectable state to the absence-detectable state, and if a difference between the sheet length of the manually inserted sheet and the reference sheet length of the assumed sheet along the sheet conveying direction is smaller than the predetermined threshold; and wherein the controller is configured to control the image forming unit to stop conveying the sheet if the first sensor is detecting presence of the sheet when the second sensor is switched from the presence-detectable state to the absence-detectable state, and if the difference between the sheet length of the manually inserted sheet and the reference sheet length of the assumed sheet along the sheet conveying direction is one of greater than and equal to the predetermined threshold.

6. The sheet conveyer according to claim 5, wherein the reference sheet length is a length of a previously conveyed sheet, which was successfully conveyed in a previous conveying operation in the sheet conveyer.

7. The sheet conveyer according to claim 5, wherein information concerning the reference sheet length is included in print data, which is received from an information terminal device.

8. The sheet conveyer according to claim 1, wherein a sheet length of the manually inserted sheet is calculated based on the measured presence-detecting duration of the second sensor and a conveying speed of the sheet;

wherein the controller is configured to control the image forming unit to continue conveying the sheet if the first sensor is detecting presence of the sheet when the second sensor is switched from the presence-detectable state to the absence-detectable state, and if a difference between the sheet length of the manually inserted sheet and the reference sheet length of the assumed sheet along the sheet conveying direction is smaller than the predetermined threshold; and wherein the controller is configured to control the image forming unit to stop conveying the sheet if the first sensor is detecting presence of the sheet when the second sensor is switched from the presence-detectable state to the absence-detectable state, and if the difference between the sheet length of the manually inserted sheet and the reference sheet length of the assumed sheet along the sheet conveying direction is one of greater than and equal to the predetermined threshold.

9. An image forming apparatus, comprising:

a manual-feed conveyer path, in which a sheet is inserted manually and conveyed along a sheet conveying direction;

a first sensor arranged along the manual-feed conveyer path and configured to detect presence of the sheet inserted in the manual-feed conveyer path;

a registration roller configured to align the sheet in a correct orientation and configured to convey the sheet having passed by the first sensor toward a downstream side along the sheet conveying direction;

a conveying belt configured to convey the sheet conveyed by the registration roller further toward the downstream side along the sheet conveying direction;

an image forming unit configured to form an image on the manually inserted sheet conveyed through the manual-feed conveyer path;

a second sensor arranged along the manual-feed conveyer path in a downstream position with respect to the registration roller and on an upstream position with respect to the image forming unit along the sheet conveying direction and configured to detect presence of the sheet in the downstream position with respect to the registration roller, the second sensor being switchable between a presence-detectable state, in which the second sensor detects presence of the sheet, and an absence-detectable state, in which the second sensor detects absence of the sheet;

a controller configured to:

measure presence-detecting duration of the second sensor, which starts when the second sensor is switched from the absence-detectable state to the presence-detectable state and ends when the second sensor is switched from the presence-detectable state to the absence-detectable state;

calculate a value based on the measured presence-detecting duration of the second sensor;

control the conveying belt to stop conveying the sheet if the first sensor is detecting presence of the sheet when the second sensor is switched from the presence-detectable state to the absence-detectable state, and if a difference between the value calculated based on the presence-detecting duration of the second sensor and a reference value obtained based on a reference sheet length of an assumed sheet along the sheet conveying direction is equal to or larger than a predetermined threshold; and control the conveying belt to continue conveying the sheet if the first sensor is detecting presence of the sheet when the second sensor is switched from the presence-detectable state to the absence-detectable state, and if the difference between the value calculated based on the measured presence-detecting duration of the second sensor and the reference value obtained based on the reference sheet length of the assumed sheet along the sheet conveying direction is smaller than the predetermined threshold.

10. The image forming apparatus according to claim 9, wherein the controller is configured to judge that the sheet is being withdrawn if the measured presence-detecting duration of the second sensor is one of greater than and equal to a reference duration corresponding to the reference sheet length of the assumed sheet along the sheet conveying direction.

11. The image forming apparatus according to claim 10, wherein the controller is configured to control the conveying belt to stop conveying the sheet when judgment is made that the sheet is being withdrawn.

12. The image forming apparatus according to claim 9, wherein the controller is configured to judge that the sheet is being withdrawn if the value calculated based on the measured presence-detecting duration of the second sensor representing a sheet length of the manually inserted sheet is one of greater than and equal to the reference sheet length of the assumed sheet along the sheet conveying direction.

13. The image forming apparatus according to claim 12, wherein the sheet length of the manually inserted sheet is calculated based on the measured presence-detecting duration of the second sensor and a conveying speed of the sheet; and wherein the controller is configured to control the conveying belt to continue conveying the sheet if the first sensor is detecting presence of the sheet when the second sensor is switched from the presence-detectable state to the absence-detectable state, and if a difference between the sheet length of the manually inserted sheet and the reference sheet length of the assumed sheet along the sheet conveying direction is smaller than the predetermined threshold; and wherein the controller is configured to control the conveying belt to stop conveying the sheet if the first sensor is detecting presence of the sheet when the second sensor is switched from the presence-detectable state to the absence-detectable state, and if the difference between the sheet length of the manually inserted sheet and the reference sheet length of the assumed sheet along the sheet conveying direction is one of greater than and equal to the predetermined threshold.

14. The image forming apparatus according to claim 13, wherein information concerning the reference sheet length is included in print data, which is received from an information terminal device.

15. The image forming apparatus according to claim 13, wherein the reference sheet length is a length of a previously conveyed sheet, which was successfully conveyed in a previous conveying operation in the sheet conveyer.

16. The image forming apparatus according to claim 9, wherein the controller controls the image forming unit to start forming the image on the sheet based on output results from the second sensor.

17. The image forming apparatus according to claim 16, further comprising:

a third sensor arranged in a downstream position with respect to the image forming unit and configured to detect presence and absence of the sheet being conveyed, wherein a distance between the second sensor and the third sensor along the sheet conveying direction is greater than the reference sheet length of the assumed sheet.

18. The image forming apparatus according to claim 9, wherein the image forming unit is a direct tandem-typed image forming unit, which is configured to form a colored image by layering multi-colored images formed in a plurality of colors of developer agents onto the sheet being conveyed.

19. The image forming apparatus according to claim 9, wherein the image forming unit is an intermediate transfer-typed image forming unit, which is configured to form a colored image by transferring multi-colored images formed on an intermediate transfer member onto the sheet being conveyed.

20. The image forming apparatus according to claim 9, wherein a sheet length of the manually inserted sheet is calculated based on the measured presence-detecting duration of the second sensor and a conveying speed of the sheet; and wherein the controller is configured to control the conveying belt to continue conveying the sheet if the first sensor is detecting presence of the sheet when the second sensor is switched from the presence-detectable state to the absence-detectable state, and if a difference between the sheet length of the manually inserted sheet and the reference sheet length of the assumed sheet along the sheet conveying direction is smaller than the predetermined threshold; and wherein the controller is configured to control the conveying belt to stop conveying the sheet if the first sensor is detecting presence of the sheet when the second sensor is switched from the presence-detectable state to the absence-detectable state, and if the difference between the sheet length of the manually inserted sheet and the reference sheet length of the assumed sheet along the sheet conveying direction is one of greater than and equal to the predetermined threshold.

21. A sheet conveyer configured to convey a sheet in a predetermined conveyer path along a predetermined sheet conveying direction from an upstream side toward a downstream side, the sheet having a predetermined sheet length along the sheet conveying direction, comprising:

a first sensor arranged along the conveyer path and configured to detect presence and absence of the sheet when the sheet passes by the first sensor, the first sensor being configured to output presence-detectable signals indicating presence of the sheet when presence of the sheet is detected and absence-detectable signals indicating absence of the sheet when absence of the sheet is detected;

an upstream-side conveyer arranged along the conveyer path in a downstream position with respect to the first sensor along the sheet conveying direction and configured to convey the sheet having passed by the first sensor toward the downstream side;

a downstream-side conveyer arranged along the conveyer path in a downstream position with respect to the upstream-side conveyer along the sheet conveying direction and configured to convey the sheet conveyed by the upstream-side conveyer further toward the downstream side;

a second sensor arranged along the conveyer path in a downstream position with respect to the upstream-side conveyer along the sheet conveying direction and configured to detect presence and absence of the sheet when the sheet passes by the second sensor, the second sensor being switchable between a presence-detectable state, in which the second sensor detects presence of the sheet, and an absence-detectable state, in which the second sensor detects absence of the sheet; and a controller configured to:

obtain assumed duration, which is assumed to be required for an assumed sheet having a reference sheet length to be conveyed for a predetermined distance;

measure presence-detecting duration of the second sensor, which starts when the second sensor is switched from the absence-detectable state to the presence-detectable state and ends when the second sensor is switched from the presence-detectable state to the absence-detectable state;

control the downstream-side conveyer to continue conveying the sheet, if the first sensor is outputting the presence-detectable signals when the second sensor is switched from the presence-detectable state to the absence-detectable state, and if a difference between the measured presence-detecting duration of the second sensor and the obtained assumed duration is smaller than a predetermined threshold; and control the downstream-side conveyer to stop conveying the sheet if the first sensor is outputting the presence-detectable signals when the second sensor is switched from the presence-detectable state to the absence-detectable state, and if the difference between the measured presence-detecting duration of the second sensor and the obtained assumed duration is one of greater than and equal to the predetermined threshold.

22. The sheet conveyer according to claim 21, further comprising:

an image forming unit configured to form an image on the sheet conveyed through the conveyer path, wherein the second sensor is arranged in an upstream position with respect to the image forming unit along the sheet conveying direction.

23. The sheet conveyer according to claim 22, wherein the controller controls the image forming unit to start forming the image on the sheet based on output results from the second sensor.

24. The sheet conveyer according to claim 23, further comprising:

a third sensor arranged in a downstream position with respect to the image forming unit and configured to detect presence and absence of the sheet being conveyed, wherein a distance between the second sensor and the third sensor along the sheet conveying direction is greater than the reference sheet length of the assumed sheet.

25. The sheet conveyer according to claim 22, wherein the image forming unit is a direct tandem-typed image forming unit, which is configured to form a colored image by layering multi-colored images formed in a plurality of colors of developer agents on the sheet being conveyed.

26. The image forming apparatus according to claim 22, wherein the image forming unit is an intermediate transfer-typed image forming unit, which is configured to form a colored image by transferring multi-colored images formed on an intermediate transfer member onto the sheet being conveyed.

* * * * *